US010780336B2

(12) United States Patent
Kinsella et al.

(10) Patent No.: US 10,780,336 B2
(45) Date of Patent: Sep. 22, 2020

(54) SYSTEMS AND METHODS FOR ELECTRONIC TARGETING OR HIT/TOUCH DETECTION

(71) Applicant: IoTargeting LLC, Marshall, TX (US)

(72) Inventors: Robert Kinsella, Red Deer (CA); Paresh Patel, Marshall, TX (US); Alan Loudermilk, Marshall, TX (US)

(73) Assignee: IoTargeting LLC, Marshall, TX (US)

( * ) Notice: Subject to any disclaimer, the term of this patent is extended or adjusted under 35 U.S.C. 154(b) by 0 days.

(21) Appl. No.: 15/911,029

(22) Filed: Mar. 2, 2018

(65) Prior Publication Data

US 2019/0168098 A1 Jun. 6, 2019

Related U.S. Application Data

(60) Provisional application No. 62/466,362, filed on Mar. 2, 2017.

(51) Int. Cl.
*A63B 71/06* (2006.01)
*A63B 1/00* (2006.01)

(52) U.S. Cl.
CPC ..... *A63B 71/0619* (2013.01); *A63B 1/00* (2013.01); *A63B 2071/0694* (2013.01)

(58) Field of Classification Search
CPC ..... A63B 71/0619; A63B 1/00; A63B 2071/0694
See application file for complete search history.

(56) References Cited

U.S. PATENT DOCUMENTS 9,631,906 B2 * 4/2017 English ..... F41J 5/052
2016/0091285 A1 * 3/2016 Mason ..... F41J 5/04 273/372

* cited by examiner

*Primary Examiner* — Jeffrey S Vanderveen
(74) *Attorney, Agent, or Firm* — Loudermilk & Associates

(57) ABSTRACT

The present invention provides systems and methods for electronic targeting, and hit or touch detection of projectiles or objects, such as from some type of gun, bow (archery), ball, human touch, animal touch. Targets/nodes have hit/touch/contact detection implements and are in radio communication with a gateway, which may be standalone or integrated into a master target. The gateway is in radio communication with an app on a smart device and also includes the capability for data connectivity to the cloud. Electronic gaming and other touch event activities remote activities of geographically disparate groups of targeting-type or hit/touch/contact detection implements are provided.

8 Claims, 32 Drawing Sheets

1

Seq#4: Game start LED sequence
Seq#5: Game end LED sequence

Introduction

The IoTargeting is a perfect product for target training.

IoTargeting hardware contains two types of devices:

- MT [Master Target]
- ST [smart Target]

Troubleshooting

- If your MT/ST fails to connect initially and you see the light on front displaying YELLOW, please try charging/altering your MT/ST battery to see if it then will connect and display a predominantly green light.
- Any local source of radio noise may effect operation of the system. This may include poorly regulated fans or other devices running electric motors, noisy power supplies or other low quality electrical and Set up your MT Share WiFi

| Network name | CHOOSE |
|---|---|
| Password | SHOW |

☐ Remember configuration

Let's get your MT on your home Wi-Fi network.

OK, DONE 1 2 3 4 5 6

← Choose Network ↻

| |
|---|
| 5ccf7f188208 |
| 5ccf7f84c05d |
| 5ccf7f84c0b9 |
| 5ccf7f84cea4 |
| 5ccf7f84f04a |
| 5ccf7f84f120 |
| 5ccf7f84f699 |
| 5ccf7f8571c6 |
| C17001 |
| dd-wrt |

!

No Password?

The password field was left blank. Are you sure this router doesn't use a password?

CANCEL CONTINUE

FIG. 17B

SYSTEMS AND METHODS FOR ELECTRONIC TARGETING OR HIT/TOUCH DETECTION

FIELD OF THE INVENTION

The present invention relates to systems and methods for electronic targeting or hit or touch/contact detection of projectiles or objects, whether from some type of gun, bow (archery), ball, human touch, animal touch, other touch or other gaming or entertainment or tracking implement or device, including industrial touch sensing, and more particularly to target-type and hit/touch/contact detection implements preferably including RF or other types of wireless capability for communicating data indicative of target or implement contact, including target-type devices at a shooting event, to one or more remote devices, which may include a mobile device such as a smartphone, tablet or PC, and which may include a gateway (included in a target-type implement or a mobile device or a standalone gateway device) for communicating such data to the cloud/Internet for remote storage, review and analysis, and also including remote gaming or other activities of geographically disparate groups of targeting-type or hit/touch/contact detection implements.

BACKGROUND OF THE INVENTION

Shooting type sports (guns of all types, shooting all types of ammunition or projectiles), ball sports and human touch-type sports are desirable activities for many people, offering advantages of entertainment, physical activity, competitive or group play and the like. Various types of targets may be used, with some targets having the ability to electronically detect "hits" or scores. Some devices may include electronic connectivity to record hits or scores. There are limitations of existing devices, and there is a perceived desire for improvements in systems and methods for electronic targeting of projectiles, whether from some type of gun, bow (archery), ball, human touch or other gaming or entertainment implement or device, and in general for electronic detection of touch events and connectivity to a mobile device (local or remote) and for transmitting and storing data relating to such targeting and/or touch events.

SUMMARY OF THE INVENTION

The present invention provides numerous such improvements. In accordance with the present invention, systems and methods are provided for electronic targeting of projectiles, whether from some type of gun, bow (archery), ball, human touch, animal touch or other gaming or entertainment implement or device. In preferred embodiments, target-type or other scoring (goals, etc.) implements preferably include RF or other wireless capability for communicating data indicative of target contact and/or shooting events to one or more remote devices, which may include an app or other software application on a mobile device such as a smartphone, table or PC. This may preferably be achieved via a gateway (included in a target-type implement or a mobile device or as a standalone gateway), which may also facilitate communicating such data to the cloud/Internet for remote storage, review, score keeping and analysis, and also for remote gaming of geographically disparate groups of targeting-type implements. Industrial applications utilizing one or a plurality of touch-sensitive devices with radio connectivity to other touch-sensitive devices, for connection to the cloud and/or a smart device also are provided by embodiments of the present invention. The target-type implements (herein generally "targets") preferably may include one or more light sources (e.g., LEDs), which may indicate (for example) a color such as green for "ready to hit" status, and a color such as "red" for "hit" status. Optional audio capability for such indications (e.g., a sound indicating "ready to hit" or "hit") may be provided with a speaker, buzzer, or other audio transducer, etc. The RF/wireless capability in the targets preferably includes a wireless mesh networking protocol such that each target may communicate status information to other targets, such as for synchronized operation and for communicating data to a gateway which may then transfer data to the app/mobile device and/or the cloud/Internet.

Such targets and related methods enable shooting and other competitions with improved scoring, entertainment, etc., which may happen in a single or multiple locations (which may be geographically remote, etc.). Data regarding such events may be stored in the cloud (e.g., remote Internet-based server(s)) for subsequent review, scoring, analysis, gaming, etc. Objects of the present invention include such attributes as described above and hereinafter, including in attachments hereto.

BRIEF DESCRIPTION OF THE DRAWINGS

The above objects and other advantages of the present invention will become more apparent by describing in detail the preferred embodiments of the present invention with reference to the drawings which are either attached or included in attachments hereto.

FIGS. 17A to 17E illustrate MT registration and update functions (generally, blocks 5, 5.1 to 5.6, and 7 of FIG. 16).

DETAILED DESCRIPTION OF THE PREFERRED EMBODIMENTS

The present invention will be described in greater detail with reference to certain preferred and alternative embodiments. As described below, refinements and substitutions of the various embodiments are possible based on the principles and teachings herein.

Illustrative preferred embodiments will be described with reference to various drawings and attachments.

Figure 1:
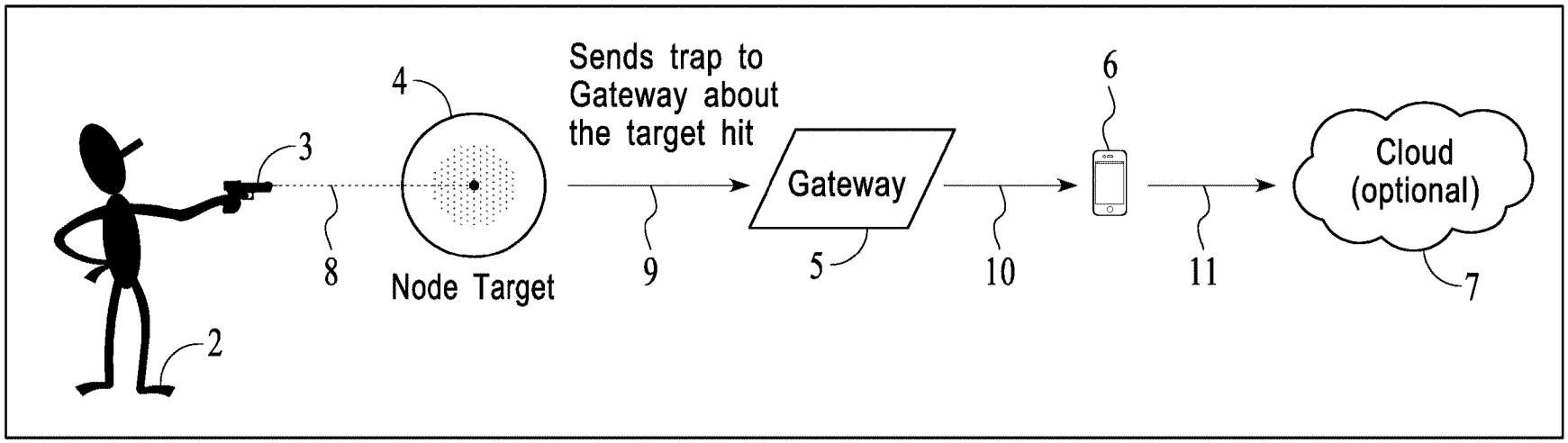
FIG. 1 is a diagram illustrating an exemplary embodiment of the present invention.

Referring now to FIG. 1 and overall system 1, certain aspects of exemplary preferred embodiments of the present invention will be described. In certain preferred embodiments, gun 3 (which in certain preferred embodiments may be an air soft gun, foam projectile launcher such as Nerf™), operated by user 2 launch projectiles illustrated by line 8 (e.g., what are known as air soft pellets, BBs or foam projectiles) towards target 4. Target 4 is in radio communication with gateway 5 via radio connection or link 9. Target 4 thus may detect hits from the projectiles and communicate the "hit" status to gateway 5 via messages/data transfers (sometimes called "traps") via radio link 9. Other status information also may be conveyed from target 4 to gateway 5 via such messages/data transfers, such as battery status, operating mode status or other status information. Targets are sometimes referred to as nodes, which in general distinguish nodes from gateways. As explained in greater detail hereinafter, the node circuitry and function and the gateway circuitry and function may be integrated into the same physical target or other device (sometimes referred to as a "master target" or MT. Also, while only a single target 4 is illustrated in FIG. 1, in preferred embodiments multiple targets 4 are connected to one or more gateway 5.

Gateway 5 is in radio communication with smart device 6 (which may be a smart phone, tablet, PC or other electronic and preferably handheld device), which preferably runs an app/application with radio connectivity (e.g., WiFi, Bluetooth) and a graphical user interface for displaying status, operation and control icons and information. In preferred embodiments, gateway 5, either through smart device 6 or through a network connection (e.g., WiFi) provided via the gateway, communicates status and operation information to cloud 7. FIG. 1 illustrates data communication 11 between smart device 6 and cloud 7, but this data communication path is exemplary. What is important is that hit/contact detection information is communicated to smart device 6 and preferably cloud 7 for game play, data collection or control purposes. Also, it should be noted that in preferred embodiments, the illustrated communication paths 9, 10 and 11 are bidirectional, such that target 4 may be controlled (e.g., control of LEDs in target 4 and in certain embodiments motion) via messages received from gateway 5, which may in turn originate from smart device 6 and/or cloud 7. Also, also within the scope of the present invention, is a radio channel (e.g., WiFi or Bluetooth) between gateway 5 and smart device 6, and a network connection to cloud 7, which may be via a WiFi or other network connection in gateway 5.

As will be appreciated, with the system illustrated in FIG. 1, target hits/contacts may be reported via data/messages sent to a gateway, which in turn passes data/messages to an app on a mobile device (in an exemplary manner illustrated as a smart phone), which in turn may optionally pass such data/messages to the cloud (Internet), or the gateway may pass data/messages directly to the cloud (online mode). In an offline mode, data/messages reporting hit/contact events (including target identification, time stamps and the like, may be received by the app and stored in the app. In such embodiments, at a later point in time when Internet connectivity is present, the app may then transmit data to the cloud for storage, analysis and the like. In some embodiments, in an offline mode the app stores just results from games (e.g., scores), but in other embodiments, the app keeps a running log of events (e.g., hits, target/target group identification, time stamps, other game context information, etc., so that a log of such events is created. With such a log, the actual game could re-enacted via a playback of the events (such as showing timing of target hits on a display of the smart device). In either case, results or logs of events may subsequently be transmitted to the cloud when Internet connectivity is again present.

In illustrative preferred embodiments as explained in greater detail hereinafter, multiple gaming modes are provided. The different modes enable, for example, LEDs or other lights on the target to assume one color (or blink pattern) when ready to hit, and another color (or blink pattern) upon hit or contact detection (red and green colors being exemplary). Other modes are within the scope of the present invention, such as time sequencing of targets in the ready to hit color for a predetermined period of time, which changes to the hit color if hit within the predetermined period of time, or optionally turning off if no hit occurs during the predetermined period of time. Time periods and hits may be recorded via messages in the app and/or cloud, as will be appreciated. Another exemplary mode is that the targets sequentially step through a ready to hit state (color or blink pattern), and once hit the color changes to the hit state (color or blink pattern) and another target enters the ready to hit state and so on until all targets have been hit, with, for example, start and stop times recorded on the app and/or the cloud. All such modes being exemplary in different embodiments, with numerous additional game modes further described elsewhere herein.

Figure 2:
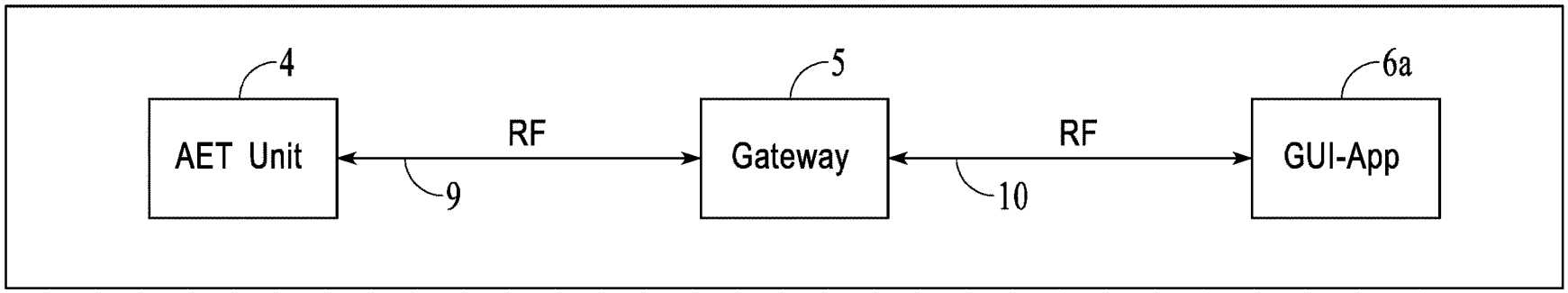
FIG. 2 is a diagram illustrating an exemplary embodiment of the present invention.

Such exemplary preferred embodiments may be further understood with reference to FIG. 2, which is a block diagram illustrating target (hit/contact detection device) 4 (or "AET unit", airgun electronic target) in preferably bidirectional radio communication via RF link 9 with gateway 5, which in turn is in preferably bidirectional radio communication via RF link 10 with GUI-App 6*a*, which preferably is an app or application running on a smart device such as smart device 6 illustrated in FIG. 1.

Figure 3:
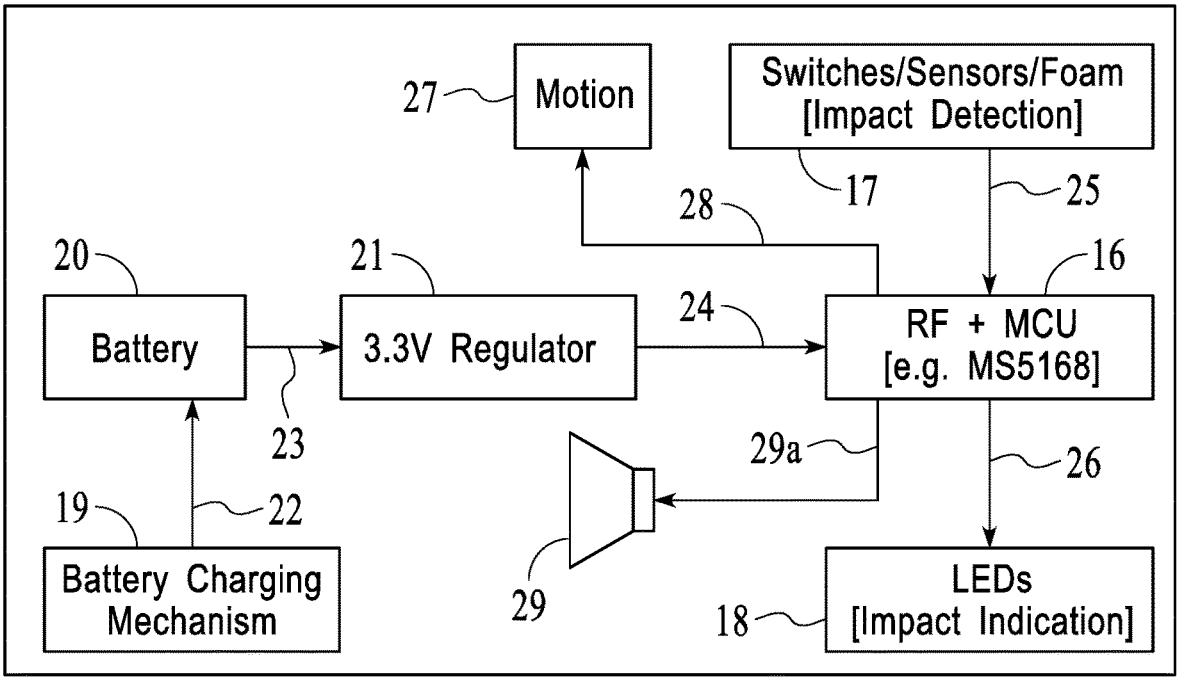
FIG. 3 is a diagram illustrating hardware components/functional blocks in accordance with certain preferred and alternative embodiments of the present invention.

FIG. 3 illustrates exemplary components/functional blocks of target/node 15 (which may be an exemplary target/hit detect device 4 as previously described). Target/node 15 preferably has radio/microcontroller unit 16, which is in bidirectional radio communication with gateway 5 and/or other targets/nodes. As will be appreciated, multi-target/node operations are contemplated, whereby a user may shoot or hit one or a plurality of targets/nodes in a desired sequence or pattern. In preferred embodiments, targets/nodes preferably use radio/microcontroller unit 16 for bidirectional communications with gateway 5 or other targets/nodes 15. In preferred embodiments, radio/microcontroller unit 16 implements an IEEE 802.15.4 compliant radio function, which may, for example, a ZigBee™ or 6LoWPAN compliant radio.

Radio/microcontroller unit 16 receives signals from switches/sensors 17 for detecting hits, contact or other impact as described elsewhere herein, and thus target/node 15 is able to detect hits/contact. Radio/microcontroller unit 16 provides signals to LEDs 18, which may, for example, be to light LEDs 18 with a first particular color (or blink pattern) when in a ready-to-hit state, and for example, to light LEDs 18 with a second particular color (or blink pattern) when a hit is detected. As will be appreciated based on the description herein, with a plurality of targets/nodes 15, which may be controlled to display colors/blink patterns to convey for a ready-to-hit state for a sequence of targets/nodes in some desired or controllable sequence (with such sequence controlled by way of an app/application from smart device 6 or via messages from cloud 7), a variety of games and operational modes are provided in such preferred embodiments.

Also as illustrated in FIG. 3, power is provided to the components of target/node 15 via voltage regulator 21, which preferably receives power from battery 20, which optionally may be a rechargeable battery that is rechargeable via battery charger 19. It should be understood that the use of line power DC or AC as well as primary or rechargeable batteries are within the scope of the present invention. What is important is that target/node 15 have a source of electrical power for the exemplary illustrated components to carry out the operations as described herein.

FIG. 3 also illustrates motion inducer 27 controlled via RF/microcontroller unit 16 over signal lines 28, which in embodiments described hereinafter utilize targets that are in motion. FIG. 3 also illustrates optional audio capability for such indications (e.g., a sound indicating "ready to hit" or "hit") may be provided with a speaker, buzzer, or other audio transducer, etc. Such sound/audio capabilities may be provided via speaker/transducer 29 controlled via signal line(s) 29*a* preferably by RF/microcontroller unit 16.

Figure 4:
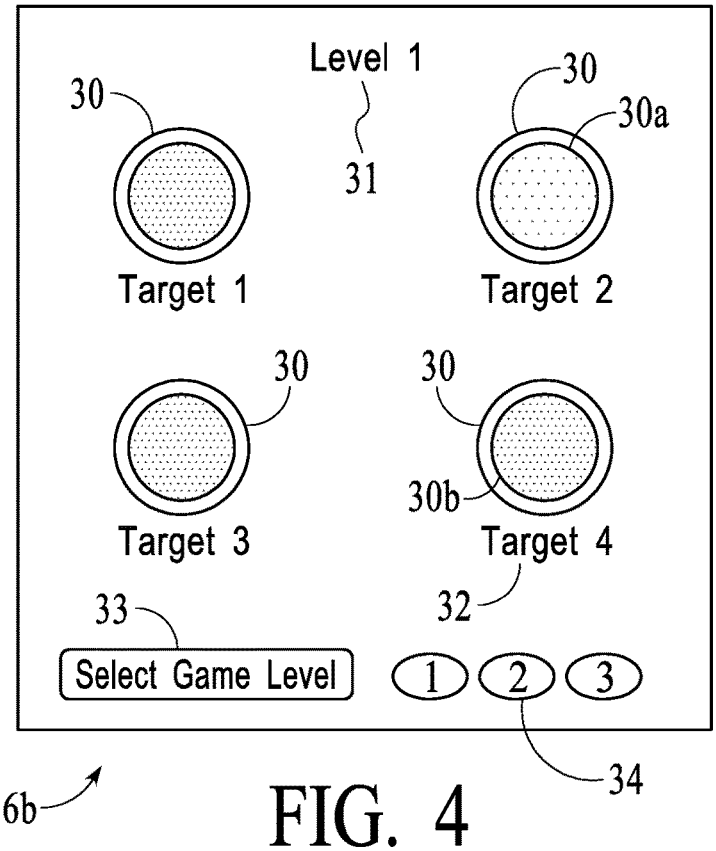
FIG. 4 is an illustrative screen shot of an app screen on a smart device in accordance with certain preferred embodiments of the present invention.

FIG. 4 illustrates exemplary screen 6*b* from an app/application (e.g., GUI-App 6*a* of FIG. 2, which may be running or displayed on smart device 6 such as illustrated in FIG. 1). In this exemplary screen 6*b*, a plurality of targets 30 are displayed on a background, with 30*a* indicating a target 30 of a first color (or blink pattern), and with 30*b* illustrating a second color (or blink pattern). Label/icon 33 illustrates a button or control feature so that a user can select one of a plurality of game levels or modes, with labels or icons 34 illustrating exemplary level selectable levels (all such icons and numbers of levels, etc., being exemplary). Icon 31 in preferred embodiments displays the selected level. While FIG. 4 illustrates a selectable level, it should be understood that such concepts are applicable to selectable modes of operation as well. What is important is that the user, via an app/application running on a smart device, may control the operation of one or a plurality of targets/nodes to operate in a selected or desired level (e.g., speed of target/node LED sequencing for "ready-to-hit" status) or mode (e.g., different game modes for sequencing target/node LEDs and "ready-to-hit status), with the hit or contact events reported back to the app/application (and the user) via the radio link between the target/node and the gateway to the app/application. And as previously described, control and status messages optionally or alternatively may be communicated to the cloud. Accordingly, app/application control of targets/nodes via a smart device and/or a cloud connection (e.g., PC connected to the Internet), with hit/contact detection events, timing and overall game or other results displayed and/or stored on the smart device and/or stored in the cloud, either of which may be for subsequent display or analysis, etc.

While additional features of UI features of preferred embodiments of apps are described hereinafter, with reference to FIG. 4 it should be noted that the number of targets shown and their location on the display is exemplary. In alternative embodiments, the location of targets on the screen are movable by the user, such as by touching a target icon for an extended period of time so that it enters a move mode; in the move mode, the target may be, for example, dragged to a new location desired by the user. Such target location/relocation by user input is within the scope of the present invention.

Figure 5:
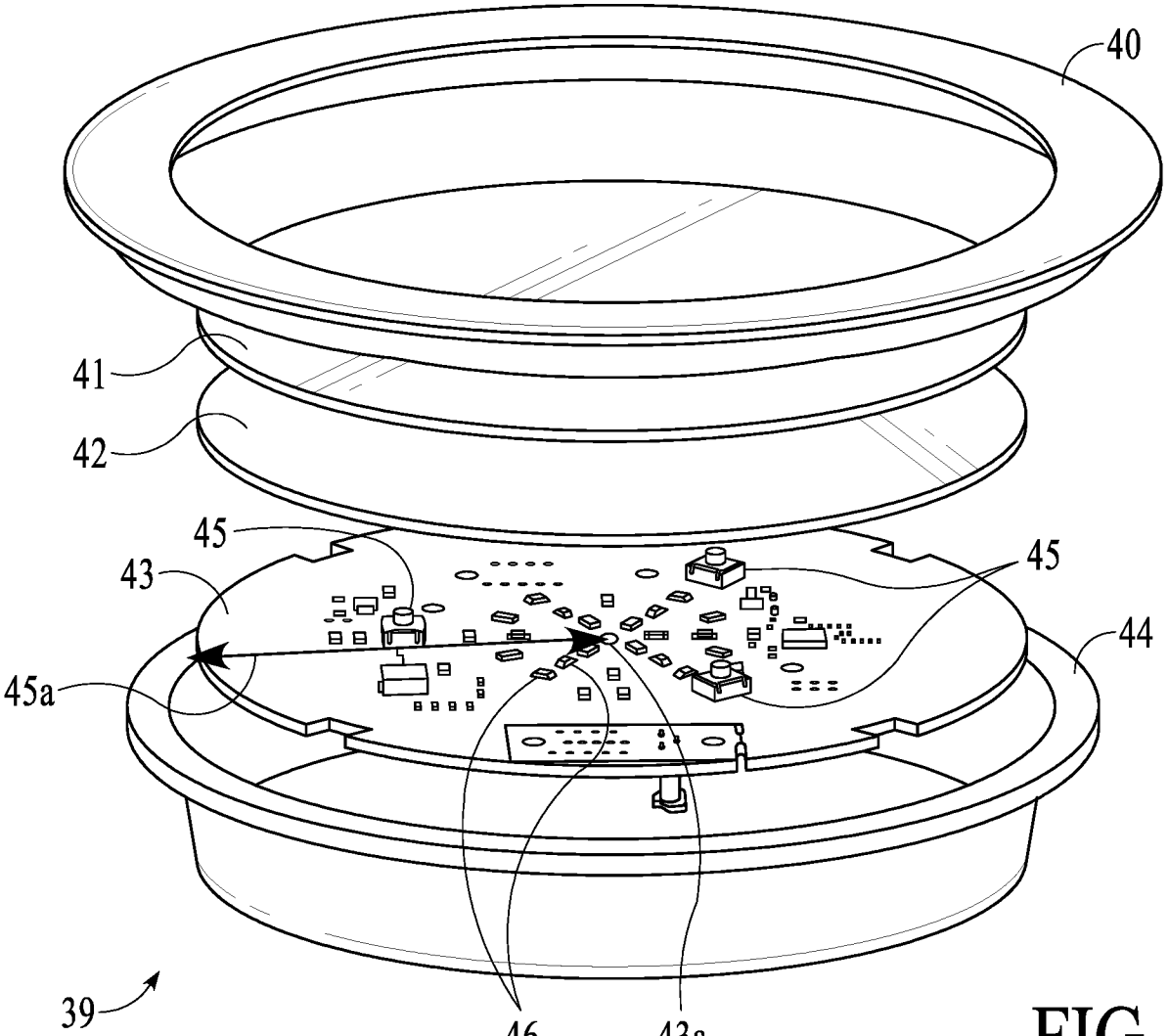
FIG. 5 is a first exploded view of a target/node (and possibly including a gateway) in accordance with certain exemplary preferred embodiments of the present invention.

Referring now to FIG. 5, exploded view 39 illustrates additional details of an exemplary construction of a target/node (which may be a master target) in accordance with the present invention. It should be understood that exploded view 39 is applicable to targets/nodes 4 and 15 as described elsewhere herein, and is also applicable for exemplary preferred embodiments in which the gateway function is integrated into a target/node.

Exploded view 39 illustrates top case/enclosure 40, preferably housing along with bottom case/enclosure 44, a sequence of layers including silicon/rubber layer 41, rigid plate 42 in contact/proximity to circuit board 43, on which is positioned switches/sensors 45 and LEDs 46. Silicon/rubber layer 41 is an optional (but preferred) layer for provided impact absorption of projectiles and touch implements and is positioned such that such projectiles impact this layer rather than rigid plate 42. Silicon/rubber layer 41 desirably reduces impact damage to rigid plate 42, and desirably reduces ricochet velocity of projectiles bouncing off of target/nodes 4, 15, etc. Top case/enclosure 40 and bottom case/enclosure 45 preferably are constructed of metal (e.g., aluminum) or plastic (e.g., HDPE), although these materials are exemplary. In certain preferred embodiments, top case/enclosure 40 may be either aluminum or plastic, depending upon the projectile that will be used to contact the target/node (e.g., high velocity projectiles such as air soft pellets/BBs being used with an aluminum or other metal top case/enclosure 40, and with foam/soft projectiles (e.g., Nerf™ projectiles) being used with a plastic top case/enclosure 40. These particular materials are illustrative, as what is important is that the preferably two enclosures house one or more layers (e.g., silicon rubber layer 42 and rigid plate 42) for receiving projectile impact, which in turn activates switches or sensors 45 on circuit board 43. Rigid plate 42 preferably is an epoxy fiber glass board with sufficient rigidity to activate switches/sensors 45 until hit/contact by the projectiles or other touching item.

As illustrated in FIG. 5, in preferred embodiments all or substantially all electronic components are included in/on circuit board 43, including switches/sensors 43 and LEDs 46 for providing colors (or blink patterns) to display "ready-to-hit" or "hit" status to a user. Also, radio and control circuitry (such as illustrated in FIG. 2 also are preferably included in/on circuit board 43), with the possible exception of a power switch which may be integral to circuit board 43 or connected with a conventional cable or wiring harness to circuit board 43 and preferably positioned on the side or back of bottom case/enclosure 44. As the present invention is intended to include high volume and low-cost applications, such a housing and layered "sandwich" arrangements helps to reduce component and manufacturing/assembly costs.

An important attribute in preferred embodiments is three switches/sensors 45 arranged to be positioned at 120 degrees spacing around an approximately center portion of circuit board 43, as illustrated in FIG. 5 (see center point 43*a*). To implement a target of reasonable spacing for targeting and gaming applications (e.g., air soft or Nerf™ type projectiles), Applicants have determined that such set-of-three switches be positioned circumferentially at equal or substantially equal 120 degree spacing, and radially at a greater than 50% spacing away from the center point of rigid plate 42 to the edge of rigid plate 42. Preferably, such set-of-three switches are positioned circumferentially at equal or substantially equal 120 degree spacings, and radially at approximately 63% of the distance from the center point of rigid plate 42 to the edge of rigid plate 42, and more preferably within +/−5% of the 63% distance point from the center point of rigid plate 42 to the edge of rigid plate 42 (see center point 42*a* of rigid plate 42 and edge point 42*b* of rigid plate 42 in FIG. 6). Without being bound by theory, Applicants have determined that the rigidity properties of an approximately 1.6 mm epoxy fiber glass rigid plate 42 and projectiles such as air soft pellets or Nerf™ type projectiles, positioning three switches away from the mid-point as described improves switch/sensor performance and hit/contact detection accuracy and reliability. It should be noted, however, that other numbers and arrangements and positioning of switches/sensors are used in alternative embodiments.

Also as illustrated in FIG. 5, a plurality of LEDs 46 preferably are symmetrically spaced circumferentially in one or more circles centered on center point 43*a*. With symmetrically spaced LEDs, e.g., 6 or more per circle and preferably color LEDs (e.g., RGB LEDs) are used to provide predetermined colors (e.g., green for ready-to-hit, red for hit, blue for do-not-hit, etc.) or color patterns (e.g., slow blink or rotate clockwise for ready-to-hit, faster blink or rotate counterclockwise for do-not-hit, and steady on or "wig wag" for hit). In alternative preferred embodiments, a user mode select via cloud 7 or mobile app 6*a* may select blink mode instead of color mode, such as if the user is color-vision impaired, and the target/node status is conveyed via blink patterns instead of colors. It should be understood that particular examples of colors and blink patterns are exemplary, and other colors and blink patterns are within the scope of the present invention. In addition, in alternative embodiments, other arrangements of LEDs are utilized, including one or more LEDs at or near the center of the target node. In such embodiments, the center LED or LEDs might be used to convey hit status, whereas circumferential LEDs convey target type or non-hit status, which might also be used advantageously to aid the use and enjoyment of vision impaired users.

Figure 6:
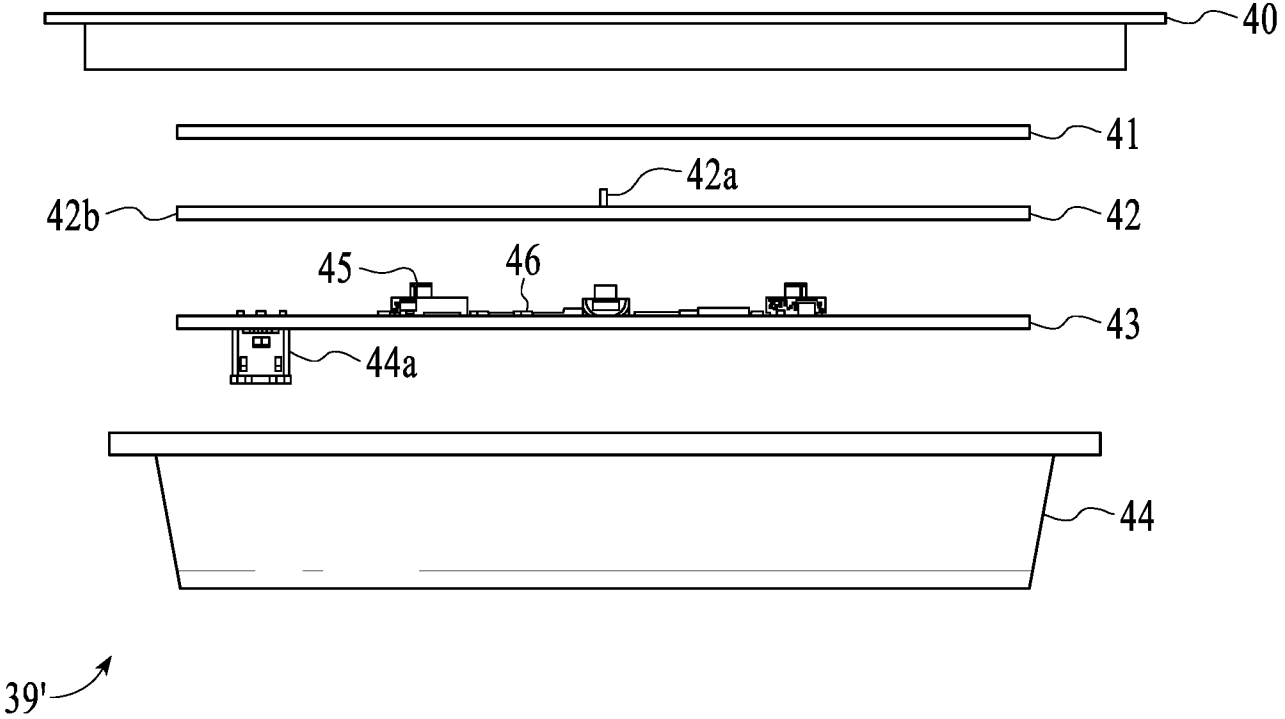
FIG. 6 is a second exploded view of a target/node (and possibly including a gateway) in accordance with certain exemplary preferred embodiments of the present invention.

FIG. 6 illustrates exploded view 39', showing a side profile of exploded view 39 of FIG. 5. FIG. 6 also illustrates power connector 44*a*, which in preferred embodiments is one of a pair of contacts that extend into a battery compartment within bottom case/housing 44 to make electrical connection to a battery pack (or batteries) within the battery compartment.

Figure 7:
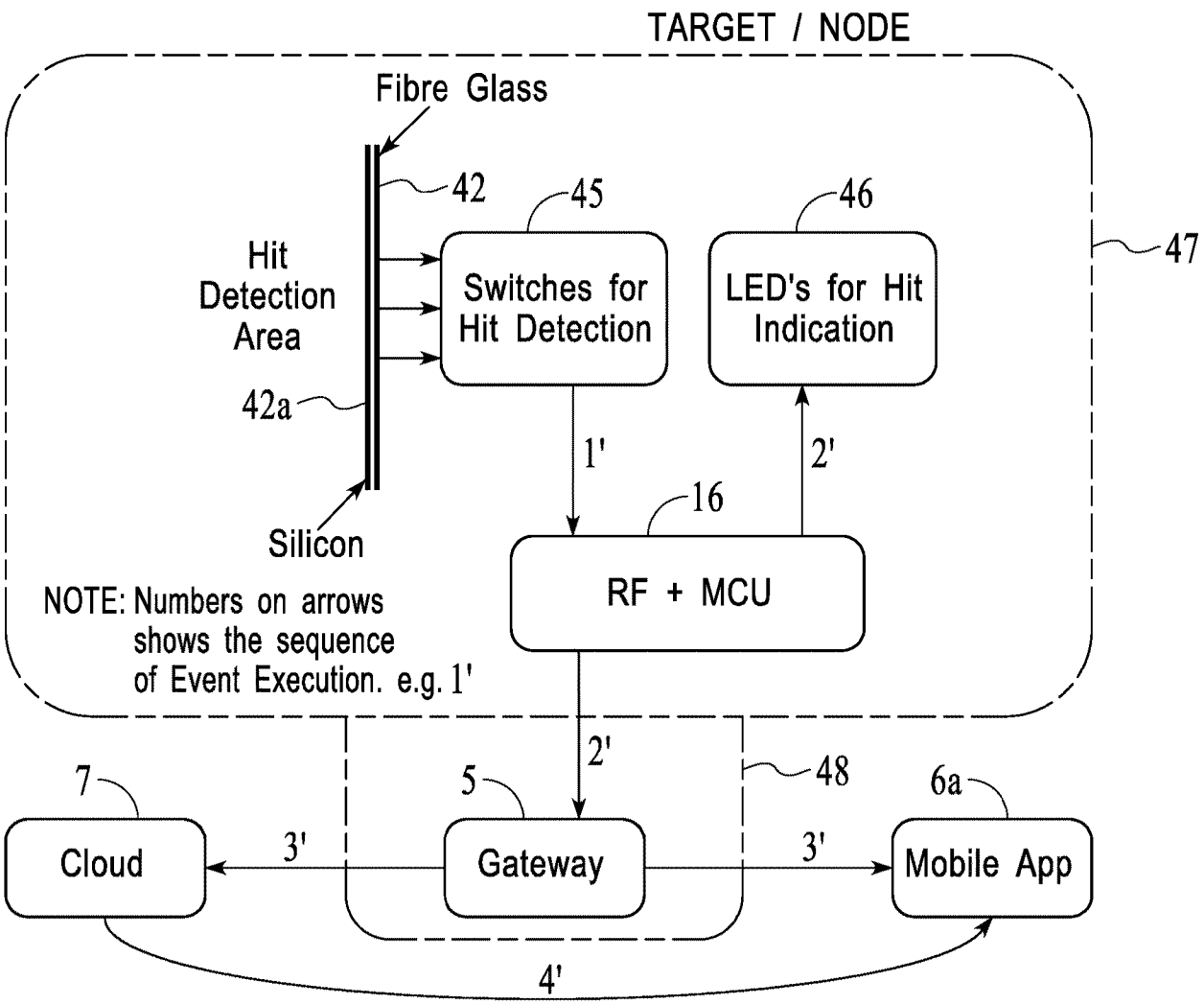
FIG. 7 is a diagram illustrating hardware components/functional blocks and communication sequencing in accordance with certain preferred and alternative embodiments of the present invention.

FIG. 7 illustrates another view of exemplary view/functional blocks of certain preferred embodiments of the present invention. Rigid plate 42 provides hit/contact detection area 42*a*, preferably making three contact points with switches/sensors 45, which are detected by radio/microcontroller unit 16 preferably on integrated circuit board 43. LEDs 46 provide, for example, "ready-to-hit" or "hit" status via predetermined colors (or blink patterns), under control of signals from radio/microcontroller unit 16 (as previously described elsewhere herein). Radio/microcontroller unit 16 is capable of bi-directional radio communications with gateway 5, and may report hit status (e.g., hit and timing of hit and an identification of which target/node among a plurality of targets/nodes coupled to gateway 5, and may provide control information to LED and operation status to the targets/nodes, all as described elsewhere herein. Gateway 5 is in communication preferably by radio to app/application 6*a* and/or to cloud 7, all as previously described elsewhere herein. FIG. 7 also illustrates an exemplary execution sequence, with arrow 1' being activation of switches/sensors 45, and arrows 2' indicating simultaneous or near-simultaneous control of LEDs 46 to indicate "hit" status and reporting of target identification/hit status/timing to gateway 5, and with arrows 3' indicating simultaneous or near-simultaneous reporting of target identification/hit status/timing to cloud 7 and mobile app 6*a*. In certain embodiments, when in online mode (i.e., gateway connected to the cloud), data/messages are conveyed from the gateway to the cloud (arrow 3') and then from the cloud to the (arrow 4') (but not from the gateway to the app). As illustrated by arrow 4', gateway 5 may, for example have its WiFi radio in network or station mode and may communicate target identification/hit status/timing to cloud 7. This allows communication to mobile app 6*a* being made from cloud 7 (as opposed to via gateway 5 via a second WiFi connectivity option). Such communication to mobile app 6*a* via gateway 5 may be via Bluetooth or WiFi (preferably if gateway 5 and smart device 6 on which mobile app 6*a* runs are on the same WiFi network or if the WiFi radio in the gateway can simultaneously support network/station mode to the cloud and AP mode for the app), and via the cloud via a WiFi connection to the smart device 6 on which mobile app 6*a* runs or via a data connection (e.g., cellular or GPRS radio connection provided in smart device 6). All such variations are included within exemplary embodiments of the present invention.

Also as noted in FIG. 7 and as described elsewhere herein, box 47 indicates functions/components within targets/nodes of preferred embodiments, and box 48 combined with box 47 indicate that gateway 5 may be integrated with functions/components of a target/node to create what may be a considered a "master target." Targets/nodes not including the gateway circuitry/function may be considered a "smart target."

Figure 8:
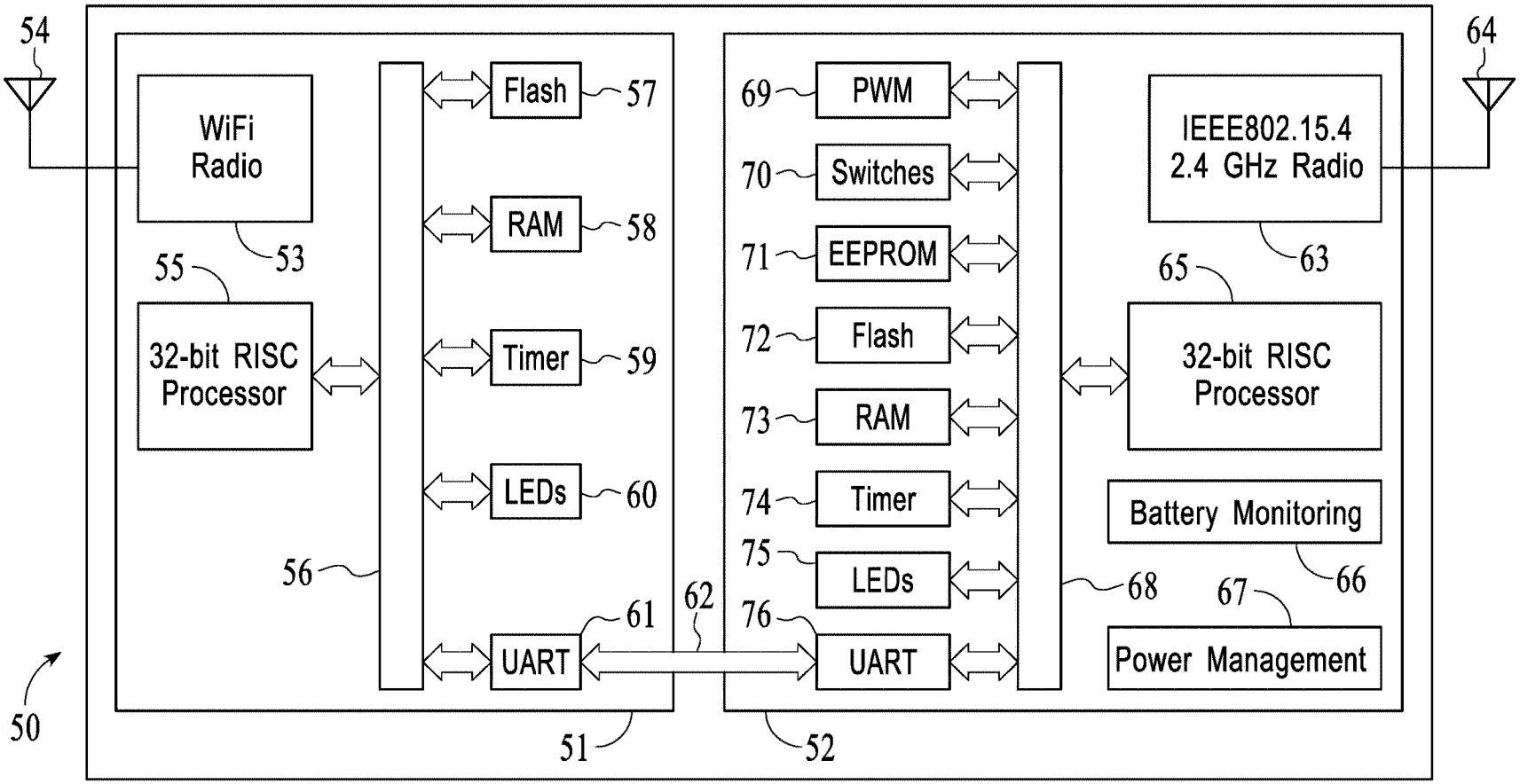
FIG. 8 is a diagram illustrating hardware components/functional blocks of targets/nodes and gateways in accordance with certain preferred and alternative embodiments of the present invention.

FIG. 8 illustrates exemplary electronic components/functional blocks of gateway 5 or of gateway components included within an integrated "master target" (including both the target/mode and gateway functions). As illustrated, circuit block 50 preferably includes WiFi/network block 51, and target/node radio block 52. WiFi/network block 51 preferably includes WiFi radio 53 coupled to radio antenna 54. WiFi radio 53 is controlled by CPU 55, which may be, e.g., a 32-bit RISC microprocessor. CPU 55 is coupled, preferably, to Flash memory 57, RAM 58, timer, 59, LEDs/LED drivers 60, and UART/serial communication port 62, all over bus 56. As illustrated, circuit block 52 preferably includes radio 63 coupled to radio antenna 64. Radio 63 (preferably an IEEE 802.15.4, 2.4 GHz radio, which may be ZigBee™ or more preferably 6LoWPAN) is controlled by CPU 65, which may be, e.g., a 32-bit RISC microprocessor. CPU 65 is coupled, preferably, to PWM controller 69, switches 70, EEPROM memory 71, Flash memory 72, RAM 73, timer, 74, LEDs/LED drivers 75, and UART/serial communication port 76, all over bus 68. Circuit block 52 also preferably includes battery monitoring circuit 66 and power management circuit 67, which may be considered components to implement the circuitry illustrated in FIG. 3, for example. Circuit block 52 also may include additional drivers/output lines for audio control and/or motion control as described in connection with FIG. 3.

What is important is that gateway 5, whether or not integrated with target/node 4, includes a radio for connection to a network (so as to connect to cloud 7, Internet, etc.) and/or to smart device 6, which may be via WiFi when gateway 5 and smart device 6 are connected to the same WiFi network, for example, or via the cloud as described elsewhere herein. Gateway 5 also may include a Bluetooth radio and communicate with smart device 6 via Bluetooth. Gateway 5 includes a radio to communicate with targets/nodes, preferably via an IEEE 802.15.4 radio. In preferred embodiments, the radio stack/controlling software also implements a self-healing mesh network protocol such that targets/nodes may connect to the gateway via one or more intermediate targets/nodes as is illustrated in FIG. 9.

Figure 9:
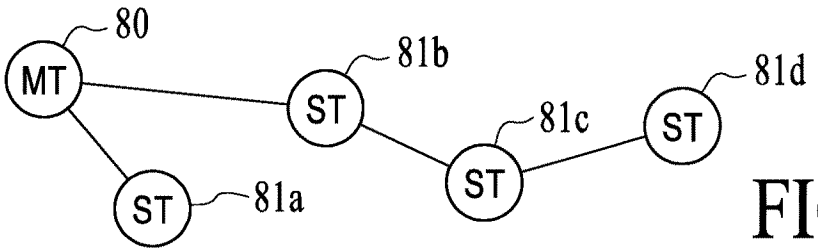
FIG. 9 is a network topology diagram for exemplary preferred embodiments of the present invention.

As illustrated in FIG. 9, master target 80, which acts as a gateway as well as a target/node, communicates with targets/nodes 81*a*, 81*b*, 81*c* and 81*d* via an 802.15.4 radio, such as previously described. Targets/nodes 81*a* and 81*b*, as illustrated, are within radio range of master target 80, and preferably connect via a radio link point to point via an 802.15.4 radio. As illustrated, however, targets/nodes 81*c* and 81*d* are outside direct radio range of master target 80, but target/node 81*c* is within range of target/node 81*b*, and target/node 81*d* is within range of target/node 81*c*. The radio stack/software running via CPU 65 includes a mesh networking function, preferably self-healing as is known in the art, thus all of targets/nodes 81*a*, 81*b*, 81*c* and 81*d* can communicate with master target 80 for communications as described elsewhere herein. It is noted that targets/nodes 81*a*, 81*b*, 81*c* and 81*d* are denoted as "ST" for "smart target," which includes the functionality of targets/nodes as described herein but not the gateway function as is included in "master target" MT 80.

As will appreciated from the foregoing description, in accordance with preferred embodiments of the present invention, airgun electronic targets (AET) and other hit/contact detection systems are provided that can report hits/contacts from one or a plurality of targets to an Android, iOS or other mobile app or smart device application. Such a system consists of at least one gateway and one or preferably a plurality of nodes which serve as the electric target devices. The gateway may be integrated into a target/node, which is sometimes referred to as a master target (MT). Targets/nodes and the gateway are networked, and once the targets/nodes are in the network, the targets/nodes will send real time messages reporting target hits, as well as target identification and preferably timing information for the hit. These messages are sent to the gateway by the nodes, and the gateway sends the messages to the end user preferably via the cloud (online mode), which reports based on the messages to the mobile phone or other smart device running the mobile app.

Exemplary process flows for certain operational aspects in accordance with certain preferred embodiments of the present invention will now be described.

Figure 10:
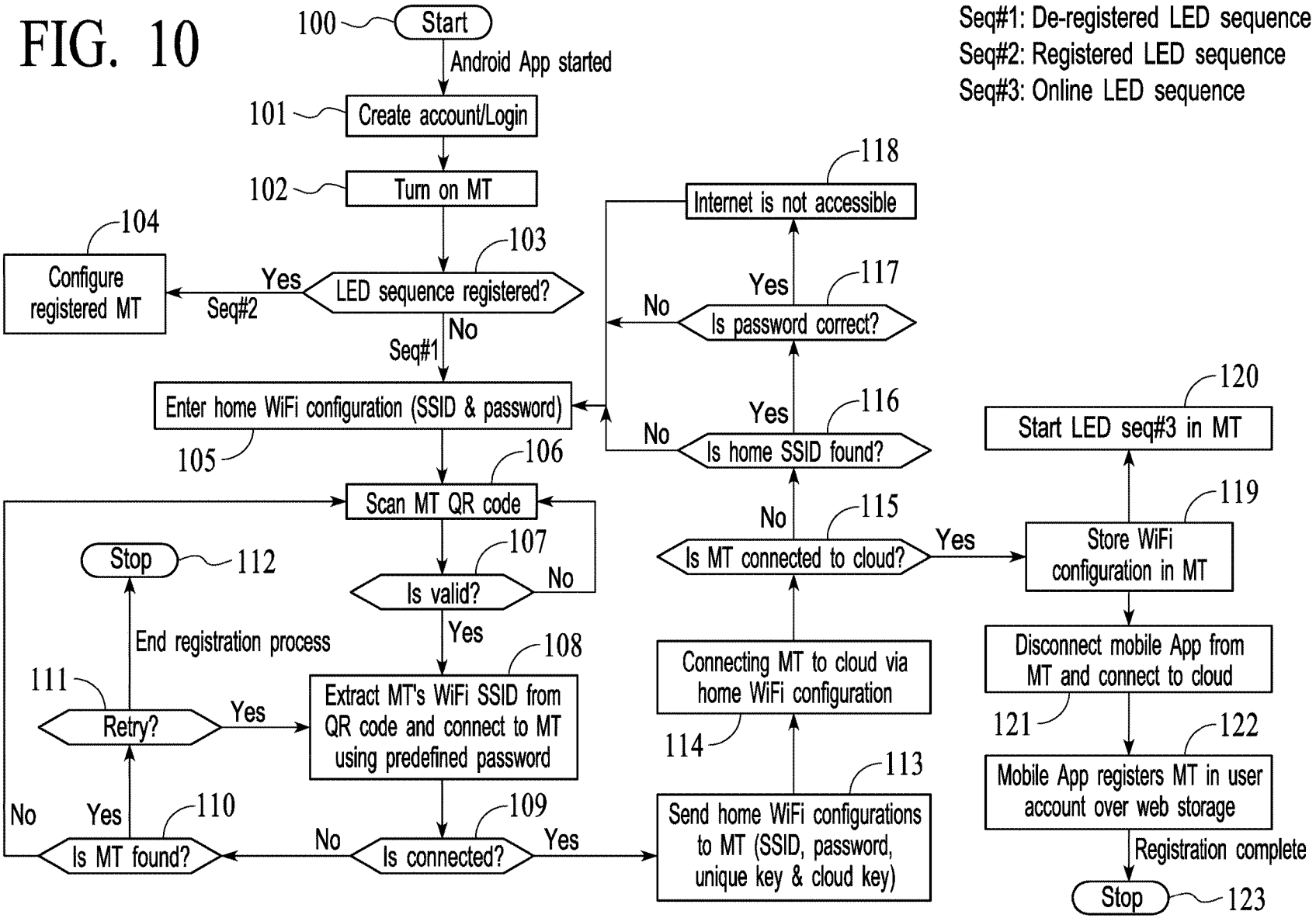
FIG. 10 is a flowchart of an exemplary process for registration of a MT (master target, which includes a gateway function) in accordance with exemplary preferred embodiments of the present invention.

FIG. 10 illustrates a preferred method/process for registering a master target (MT). At step 100, the process begins, typically by the user opening or starting the companion app on the smart device. At step 101, the user either creates a user account or logs in if the user already has an account. At step 102, the user turns on the MT, preferably by activation of a power-on switch on the MT. At step 103, it is determined if the MT is registered. If the MT is registered, LED Seq. #2 is initiated on the MT (registered LED sequence) and the process ends at step 104. If the MT is not registered, LED Seq. #1 is initiated on the MT (deregistered or unregistered LED sequence) and the process proceeds to step 105. At step 105, if necessary the user enters its home or local network WiFi configuration (SSID and password) in the app. At step 106, using the camera on the smart device the user scans the MT QR code, preferably located on a label on the MT. In preferred embodiments, a label including the QR code is automatically printed after the MT successfully completes an operational test sequence after MT assembly. In this manner, an applied label is an indication that the MT has been successfully assembled and has passed post assembly QC testing.

At step 107, it is determined whether the scanned QR code is assessed as valid (such as by data error detection or Reed Soloman techniques used for QR code data scanning and whether the data extracted from the QR code includes all expected data fields and entries, etc.). If a valid QR code is not detected, the process returns to step 106 for a re-scan. If a valid QR code is detected, the process proceeds to step 108, in which the app extracts the MT's SSID from the QR code and connects to the MT using a predefined password. At step 109, it is determined if the smart device/app can connect to the MT. If a connection is not detected, the process proceeds to step 110, and an attempt to "find" the MT is made. If the MT is found, the process proceeds to step 111, and it is determined if a retry should be made at step 108. If at step 111 a retry is not to be made (e.g., if a predetermined number of unsuccessful attempts have already been made), the registration process stops at step 112. If the MT is not found at step 110, the user may be prompted to rescan the MT QR code at step 106.

If at step 109, if it is determined that the smart device/app can connect to the MT, the process proceeds to step 113. At step 113, the home or local network WiFi configuration is sent to the MT (SSID, password), and also a unique key and cloud key are also sent to the MT from the app. As will be appreciated by those of skill in the art, the use of such keys provides data security for connection to the cloud, ensuring that only authorized devices can access the cloud service and/or interpret sent data. At step 114, the MT attempts to connect to the cloud service using the home/local WiFi configuration. If at step 115 it is determined that the MT has successfully connected to the cloud, the process proceeds to step 119, and the WiFi configuration is stored in the MT. After step 119, LED Seq. #3 (online LED sequence) is initiated at step 120, and at step 121 the mobile app disconnects from the MT, and the MT is connected to the cloud. At step 122, the mobile app registers the MT in the user account settings and stores registration information for the MT in cloud/web storage. The registration process ends at 123.

Figure 11:
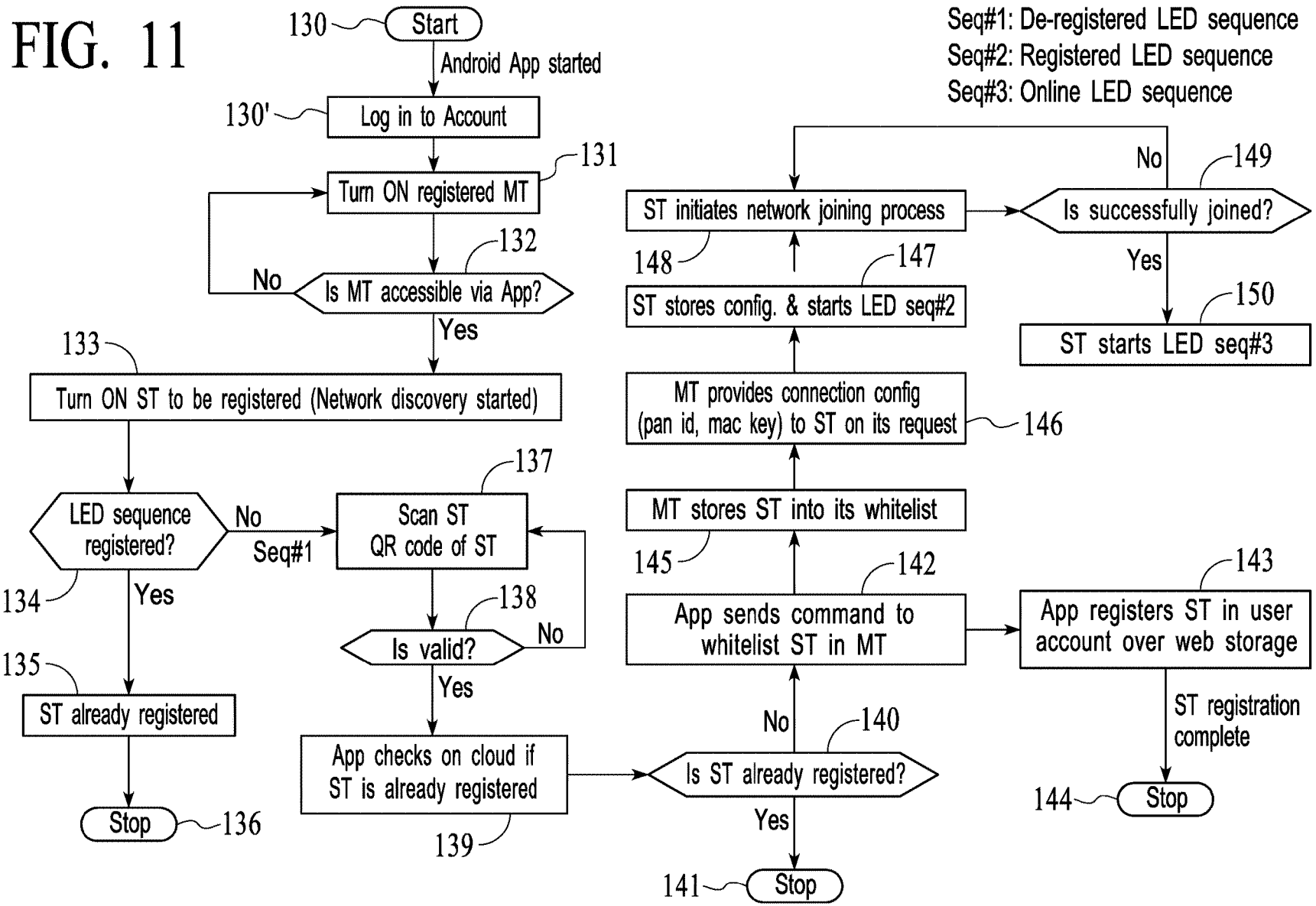
FIG. 11 is a flowchart of an exemplary process for registration of a ST (smart target, which does not include a gateway function) in accordance with exemplary preferred embodiments of the present invention.

FIG. 11 illustrates an ST ("smart target") exemplary process flow for registration of ST in a network with an MT. The process starts at step 130, with the opening of the app (which as described elsewhere herein, may be an iOS or Android or other app on a smart device). At step 130', the user is prompted to log in to their account on the app. At step 131, the user turns on a registered master target (MT) (ST cannot be registered without a previously registered MT in preferred embodiments). At step 132, it is determined if the registered MT is accessible via the app. If no, then the MT needs to be restarted until a registered MT is on and operating and accessible via the app. After the MT is determined to be accessible via app, the process proceeds to step 133, at which the user turns on the ST to be registered (typically by turning on a power switch), and network discovery of the ST begins. At step 134, a determination occurs as to whether the particular ST is already registered. The ST preferably displays an LED sequence that indicates whether it is already registered or not registered, with LED Seq. #1 indicating a deregistered or unregistered state, and LED Seq. #2 indicating a registered state. With such LED sequences, a user may quickly determine and understand if the ST is registered or not. Step 135 occurs if the target is recognized as already registered and the process then stops at 136.

At step 137, the target has not been registered and LED Seq. #1 is displayed, signaling to the user that the user should scan the ST QR code that preferably is applied to a label affixed to the ST (as described elsewhere herein, such a QR-included label may preferably be affixed to the ST after it has been assembled and passed post-assembly QC testing). At step 138, a determination if made whether scanned QR code is valid (such as by data error detection or Reed-Soloman techniques used for QR code data scanning and whether the data extracted from the QR code includes all expected data fields and entries, etc.) If the QR code scanned is determined to not be valid, step 137 is repeated; if valid, the process proceeds to step 139, at which the app communicates with the cloud to determine if the particular ST has already been registered. At step 140, if it is determined that this particular ST is already registered, the process stops at 141. If it is determined that this particular ST is not already registered, the process continues to step 142. At step 142, the app sends one or more command to the MT to add this particular ST to the "whitelist" (the approved list) stored in the MT. As is known in the art, such a whitelist entry includes identification information (e.g., such as a MAC address, serial number, etc.) of the particular device so that it may be uniquely identified from all other potential devices that might be added to the network. At step 143, the app registers the ST in the user's account settings and sends information to an external server for cloud storage, and from the app standpoint the process ends at 144. Also subsequent to step 142, the process moves to step 145, at which the MT stores the ST into the MT's whitelist. At step 146, the MT also provides the connection configuration (pan id, mac key, etc.) to the ST by way of signal exchange between the MT and ST. Upon successful signal exchange and transmission of connection confirmation information, at step 147 the ST stores the configuration information and initiates LED Seq. #2, which indicates to the user that the ST has completed the registration process. At step 148, the ST initiates joining the network of nodes with the MT. At step 149, a determination is made as to whether the ST has joined the MT's network successfully. If not, the process returns to step 148 and the network joining process is attempted again. At step 149, if the ST has successfully joined the MT's network, the process proceeds to step 150, and the ST initiates LED Seq. #3, which indicates that the ST registration has been completed and the ST is on online in the MT's network.

It should be noted that the present invention is directed, in part, to high volume applications, in which numerous targets may be deployed. It has been determined to be particularly advantageous in such an environment to deploy a scan code (e.g., QR code) to expedite and facilitate registration of gateways/MTs and targets/nodes/STs in a network.

Figure 12:
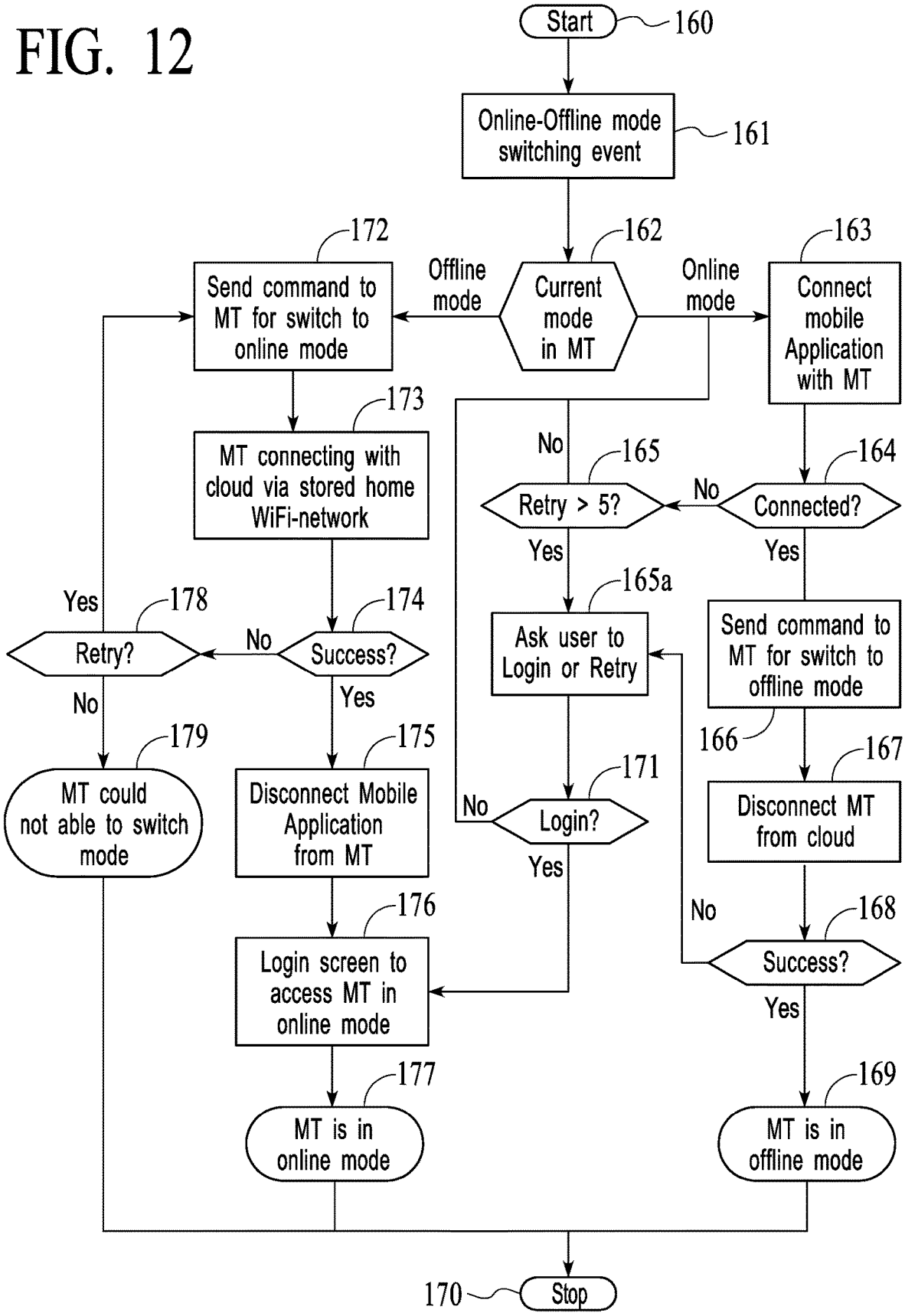
FIG. 12 is a flowchart of an exemplary process for switching between online and offline operating modes in accordance with exemplary preferred embodiments of the present invention.

FIG. 12 illustrates an exemplary process flow for switching between online (cloud connected) and offline (app connected) modes of operation. The process begins at step 160. At step 161, an online-offline mode switch event is detected (e.g., a request to switch modes is detected, or when in online mode Internet connectivity is lost, etc.). At step 162, the current mode in the MT is detected. If the current mode is online mode, the process proceeds to step 163. At step 163, the mobile app attempts to connect with the MT. At step 164, it is determined if the mobile app successfully connected to the MT. If yes, the process proceeds to step 166. At step 166, the app sends a command to the MT to switch to offline mode. At step 167, the MT attempts to disconnect from the cloud. At step 168, it is determined if the MT has successfully disconnected from the cloud. If yes, the MT operates in offline mode in step 169 and the process stops at 170. If at step 168 it is not determined that the MT has successfully disconnected from the cloud, the process proceeds to step 165*a*.

If at step 164 it is not determined that the mobile app successfully connected to the MT, the process proceeds to step 165. At step 165, it is determined if the number of retries is greater than 5. If yes, the process proceeds to step 165*a*, and the user is prompted whether to retry or login. At step 171, if the user prompts a login, the process proceeds to step 176. If the user chose a retry, the process returns to step 163. At step 176, the user is presented the login screen to access the MT in online mode. Upon successful completion of step 176, the process proceeds to step 177 and the MT is in online mode. The process then stops at 170.

If at step 162 the current mode is determined to be offline mode, the process proceeds to step 172. At step 172, a command is sent to the MT to switch to online mode. At step 173, the MT attempts to connect with the cloud using the stored home/local WiFi network settings. At step 174, it is determined if the cloud connection was successful. If yes, the process proceeds to step 175, and the mobile application is disconnected from the MT and the process proceeds to step 176. At step 176, the user is presented the login screen to access the MT in online mode. Upon successful completion of step 176, the process proceeds to step 177 and the MT is in online mode. The process then stops at 170.

If at step 174 the cloud connection was unsuccessful, the process proceeds to step 178. At step 178, the user is requested whether a retry is desired. If yes, the process proceeds to step 172, and a retry of the command being sent to the MT to switch to online mode is attempted. If at step 178 the user does not desire a retry, it is determined that the MT could not switch modes and the process stops at 170.

Figure 13A:
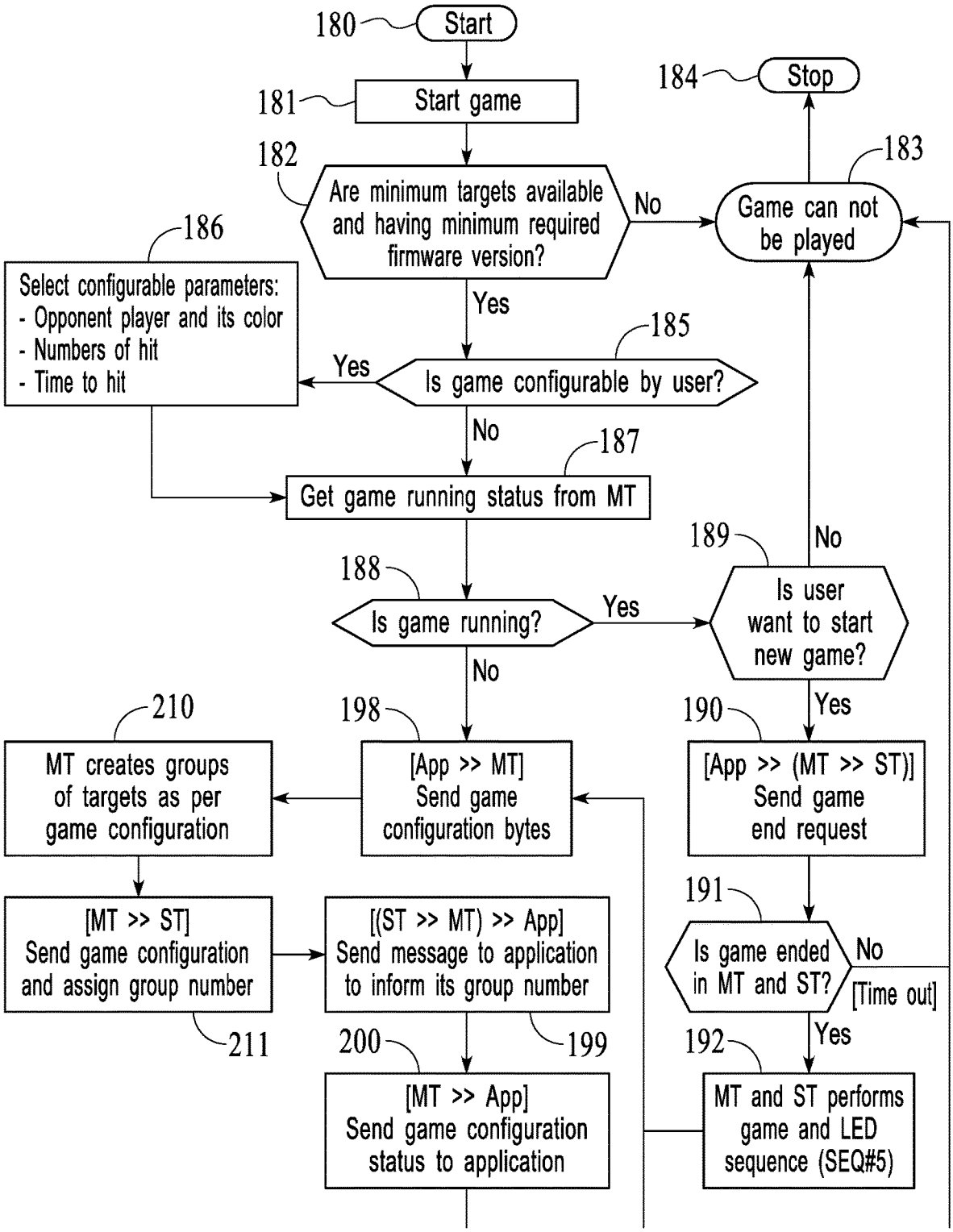
FIG. 13 is a general flowchart of an exemplary process flow for implementing various game modes in accordance with exemplary preferred embodiments of the present invention.
Figure 13B:
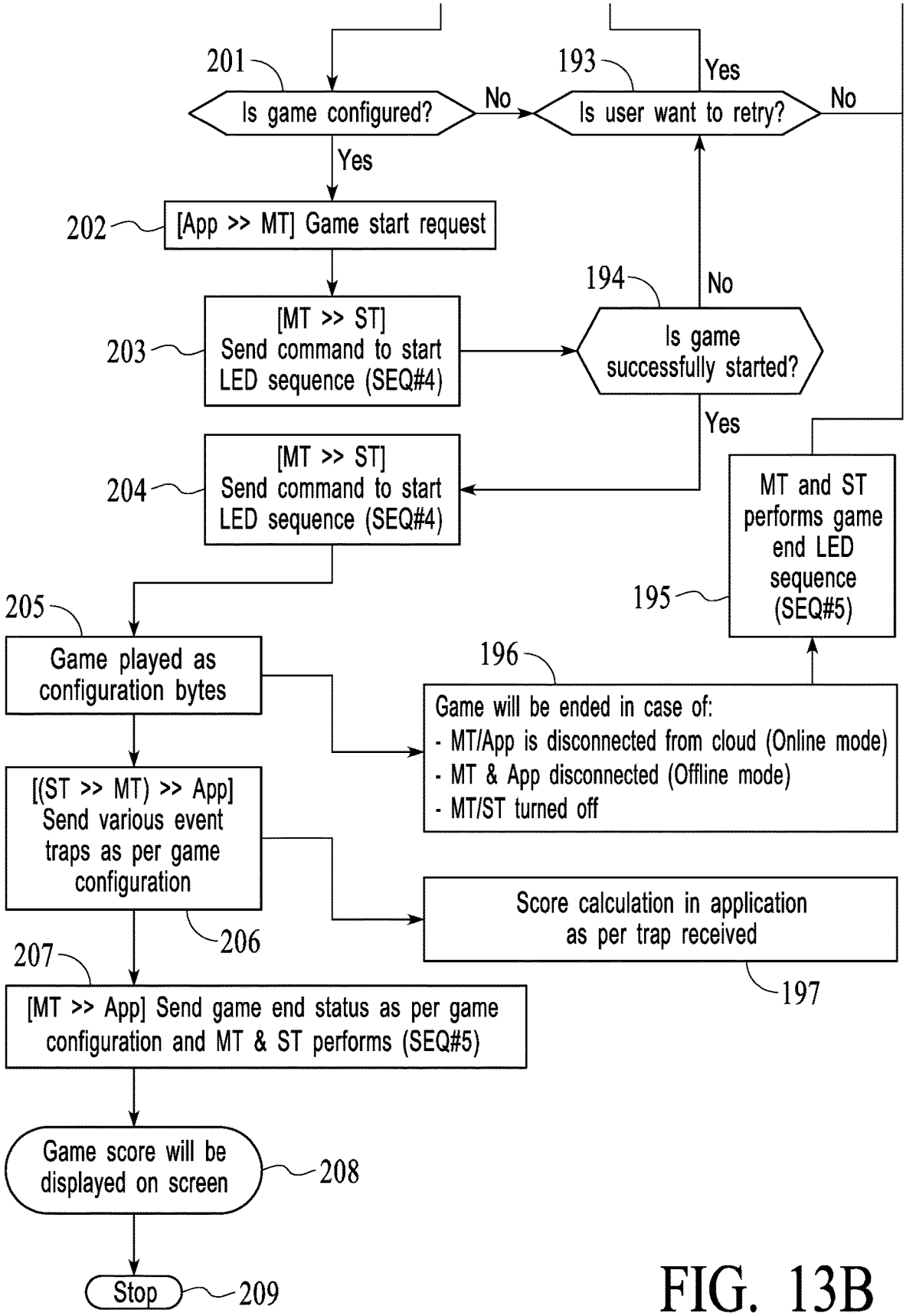

As described elsewhere herein, in accordance with the present invention, numerous game modes are possible in accordance with preferred embodiments. FIG. 13 illustrates a generic game play flowchart in accordance with certain of such preferred embodiments.

The process begins at 180. At step 181, the user initiates a desired game mode of operation (such as by selecting an icon with the mobile app). In accordance with preferred embodiments, numerous game modes may be selected by the user. At step 182, it is determined if the minimum or required number of targets are available (registered, powered on, etc.) and have the minimum required firmware version. As new firmware releases are made available, such new firmware releases may support new game modes, and at this step it is determined whether the available targets have a firmware version that supports the desired game mode. If at step 182 it is determined that the minimum number of targets having the required firmware version are not available, the process proceeds to step 183, where it is concluded that the selected game made cannot be played, and the process stops at 184.

If at step 182 it is determined that the minimum number of targets having the required firmware version are available, the process proceeds to step 185. At step 185, it is determined if the selected game is configurable by the user. If yes, the process proceeds to step 186, and game parameters are selected by the user via the app (e.g., opponent player, color selection(s) or blink pattern(s) for opponents, targets to hit, number of hits, timing parameters for hits, etc.); thereafter the process to proceeds to step 187 (which is the next step after step 186 if the selected game is not user configurable).

At step 187, the app determines the game running status from the MT (whether by prompting the MT or receipt of a status message from the MT). At step 188, it is determined if the selected game is already running. If yes, the process proceeds to step 189, where the user preferably is prompted via the app to indicate if the user wants to start a new game. If no, the process proceeds to step 183, where it is concluded that the selected game mode cannot be played, and the process stops at 184.

If at step 188 it is determined that the selected game is not already running, the process proceeds to step 198, where the app sends game configuration data to the MT. At step 210 the MT creates groups of targets and other configuration steps as per the configuration data. As will be understood by those of skill in the art, group identification is a way to logically group subsets of nodes so that they can be addressed with commands applicable to that particular group (but not other groups) (e.g., "group 1 turn LEDs on blue," "group 2 turn LEDs on green," etc., as examples of commands to which only members of particular groups will respond). At step 211, the MT sends appropriate configuration data and assign group numbers to the STs (smart targets, or targets/nodes not including the gateway function, as described elsewhere herein). It is understood that the configuration data transferred at steps 198 and 211 are a function of the particular game mode selected by the user. At step 199, the ST sends a message to the MT confirming the assigned group number (along with any other information required for the particular game), and the MT sends a message conveying such information (and along with any other required information for the particular game) to the app. At step 200, the MT preferably sends the game configuration status to the app, and at step 201 the app determines if the game is successfully and completely configured and ready for execution. If no, the process proceeds to step 193, where it is determined if the user wants to retry (if no, the process proceeds to step 183, and if yes, the process returns to step 198).

Returning to step 189, if the user wants to start a new game, the process proceeds to step 190, at which the app sends to the MT an end game request, which the MT also sends as appropriate to the particular STs. At step 191, it is determined if the game has ended in the MT and STs; if no, the process proceeds to step 183; if yes, the process proceeds to step 192, at which the MT and ST perform an end game LED sequence, and the process proceeds to step 198.

If at step 201 the app determines that the game is successfully and completely configured and ready for execution, the process proceeds to step 202, at which the app sends a game start request message to the MT. At step 203, the MT sends commands to the STs as appropriate to start the LED sequence for the selected game. At step 194, it is determined if the game has successfully started (e.g., by app determining if appropriate messages and responses are being sent/received as expected for the particular selected game. If no, the process proceeds to step 193, where the user is prompted for a retry. If yes, the process proceeds to step 204, at which the MT optionally sends commands to the STs as appropriate to start the LED sequence for the selected game, and the MT sends commands as appropriate to start the particular selected game.

At step 205, the game is played in accordance with the configuration data for the particular selected game. From 205, at step 196 the game is ended if, for example, the MT or app are disconnected from the cloud if in an online mode of operation (e.g., Internet connection drops), or if the MT and the app get disconnected if in offline mode of operation, or if the MT or ST are turned off, batteries drop below an adequate level or the like. From 205, if no termination events have occurred as described above, at step 206 the ST reports events to the MT, and the MT sends commands to the ST, and the MT reports events to the app, all as dictated by the game configuration data for the selected game. As appropriate for the particular game, at step 206 the app may move to a score calculation or other processing and/or displaying of results (or interim results) as per the events reported via the MT. At step 207, as is appropriate for the particular configuration data for the selected game, the MT sends a game end status as per the particular configuration data for the selected game, and the MT sends other commands as may be appropriate to the STs, which preferably includes an end of game LED sequence for the particular game. At step 208, preferably the final game score or results are displayed on the screen by the app, and at 209 the process ends.

As will be appreciated from the exemplary general flow illustrated and described with reference to FIG. 13, a large number of game modes are within the scope of preferred embodiments of the present invention. For example, and without limitation on the scope of alternative embodiments, the following game modes are expressly within the scope of the present invention.

Random: one target will randomly light up green, and once hit this target will change to red, another target will light up green, and the sequence continues until all targets are red; game can be configured for a predetermined number of circuits of the targets or for a set period of time; times between light up and hit detection can be logged and score kept based on running time, average time to hit, or combinations thereof, etc.

Random Time Trial: one target will randomly light up for (e.g.,) 2 seconds, and if the target is hit within the 2 seconds, it will change from green to red, and if not hit within 2 seconds the target is considered missed and preferably turns off; the game continues until all targets are considered hit or missed, and score can be kept on hits, running time to hits, average time for hits, or combinations thereof, etc.

Time Trial: hit all targets as quickly as possible, preferably with all targets starting green, and once hit targets will change to red; game can be configured for a predetermined number of circuits of the targets or for a set period of time; score kept based on running time, average time to hit all targets, or combinations thereof, etc.

Hostage Rescue: hit all terrorists, with terrorists being (e.g.,) lit green, and hostages being (e.g.,) lit blue; game preferably ends when terrorists all turned red after being hit, and preferably ends if one or more hostages are hit, etc. Scoring can be kept based on running time, and game can include multiple circuits with random changing of targets from terrorists to hostages or vice versa in each circuit, etc.

Simon Says: A memory game, in which the system will show a sequence by turning targets red in a sequenced pattern, and the player must remember the displayed sequence and hit targets in that order; preferably, there are a number of rounds, and with each additional round another target is added to the sequence; game ends (or a score deduction) if player hits the wrong target; scoring can be based on running time, etc.

Reaction Time: game tests reaction time; particular targets turn green, and the user must hit the target as quick as possible, and target can briefly turn red when hit and then off; game can be configured for a predetermined number of circuits of the targets or for a set period of time; score kept based on running time, average time to hit all targets, or combinations thereof, etc.

Follow the Leader: preferably a 2 player game, with all target starting green; player 1 starts as the leader; player 1 hits all targets in any order; player 2 must remember and hit targets in same order as player one; once done player 2 is now leader and player 1 must follow; game can be configured for a predetermined number of circuits of the leader exchange; score kept based on running time, average time to hit all targets, penalties for mis-hits, or combinations thereof, etc.

Race: preferably a 2 player game in which half of the targets turn green and the other half of the targets blue, with each player assigned a color; when target is hit it will change to red; players race to hit all of their color targets first, and whoever hits all their targets first is the winner.

Quick Draw Challenge: preferably a 2 player game, in which 1 target turns green and at the same time 1 target turns blue; each player tries to quickly hit the target of their assigned color; whoever hits theirs first is the winner.

As will be appreciated, numerous variants of such game modes and scoring options are within the scope of the present invention.

Figure 14:
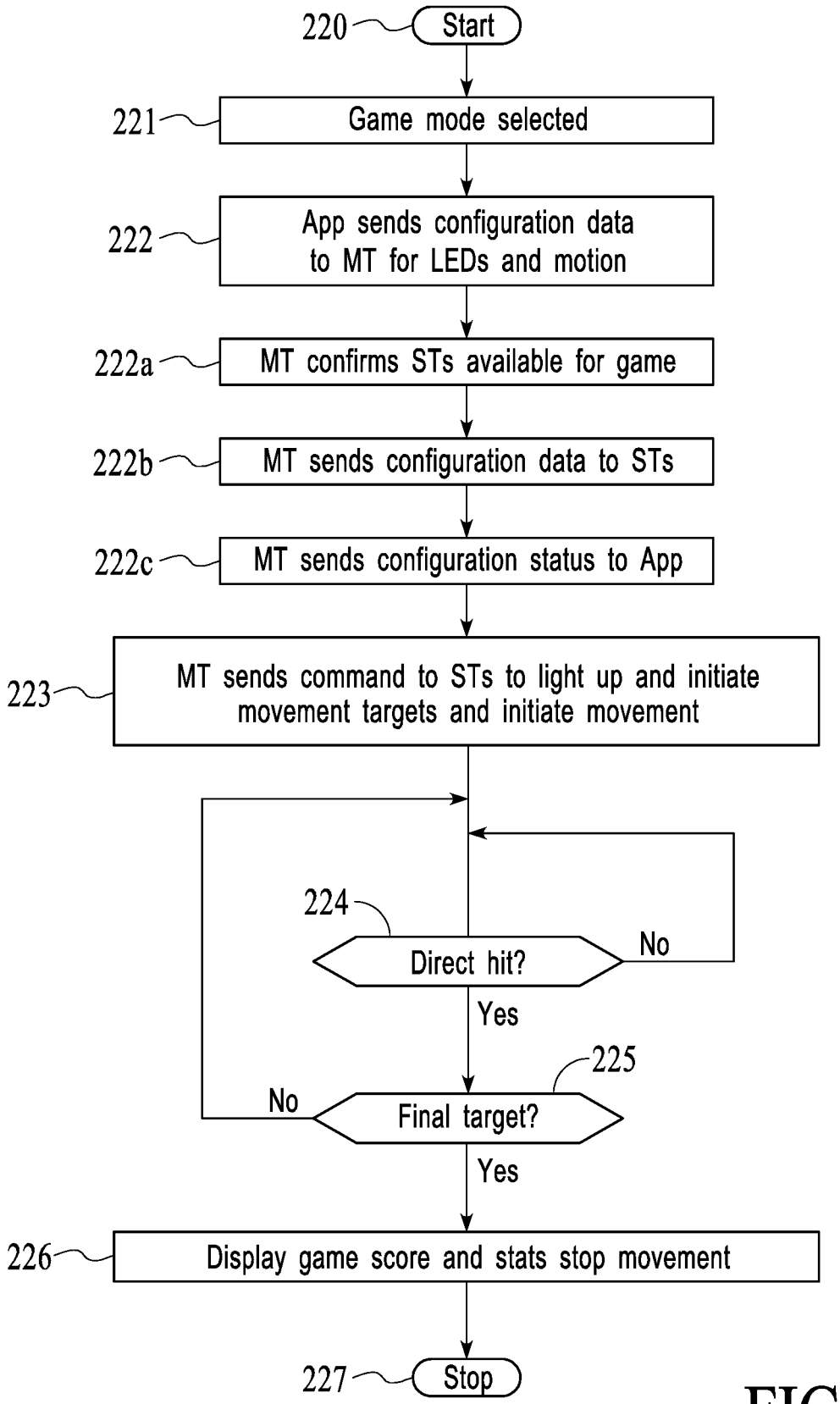
FIG. 14 is a flowchart of an exemplary process for a game mode involving movement of targets/modes in accordance with exemplary preferred embodiments of the present invention.

Referring now to FIG. 14, an alternative preferred embodiment providing an "arcade" type game mode with one or more moving targets will be described. Initially, reference is made to FIG. 3. In such alternative embodiments, motion inducer 27 is provided under control of RF/microcontroller unit 16. RF/microcontroller unit 16, in addition to controllably providing LED sequences for target status and the like (as described elsewhere herein), may control motion inducer 27 via signal line(s) 28. Such a motion inducer may be an actuator, a vibratory mechanism, or a linear or rotary motion. All such motion inducers, suitably controllable by RF/microcontroller unit 16 such that motion can be controlled synchronous with suitable LED activation, are within the scope of such alternative preferred embodiments of the present invention.

FIG. 14 illustrates a game mode involving a moving target powered by, but not limited to, an actuator, vibrator, or motor. The process starts at step 220. At step 221, "arcade" game mode is selected, preferably by user activation via the app. At step 222, the app sends configuration data for the selected arcade game to at least one registered MT. At step 222*a*, the MT confirms that STs are registered and available for the selected arcade game mode (including firmware version and the like, as described elsewhere herein). At step 222*b*, after confirmation that suitable STs are registered and available for the selected arcade game mode, the MT sends appropriate configuration data (including any group identification data) to the appropriate STs. At step 222*c*, the MT reports the configuration status of the STs and any other necessary data to the app for the selected arcade game mode. At step 223, the MT sends commands to the STs to initiate the start of game play. After gameplay is initiated, the targets light up and move based on the specific configuration data for the selected arcade game mode. Hits/contact in general are detected and reported as with other non-moving embodiments of the present invention. At step 224, it is determined if one or more targets have detected a hit. If a hit is detected, then preferably the target is turned off, motion stopped while the other targets remain in their existing state, waiting to detect a hit. This process preferably continues until all targets in the game have detected a hit, as indicated by 225, at which a determination is made if the final target has been hit. In preferred embodiments, the process proceeds to step 226, where movement of final target stops, and preferably the score and other results of the game are displayed, conveyed to the cloud, stored via the app for later transmission to the cloud, etc. Gameplay then ends at 227.

It should be understood that the general gameplay flow and game modes described elsewhere herein may be supplemented by controlled motion as described herein, and such combinations and adaptations are expressly with the scope of alternative preferred embodiments of the present invention.

Figure 15:
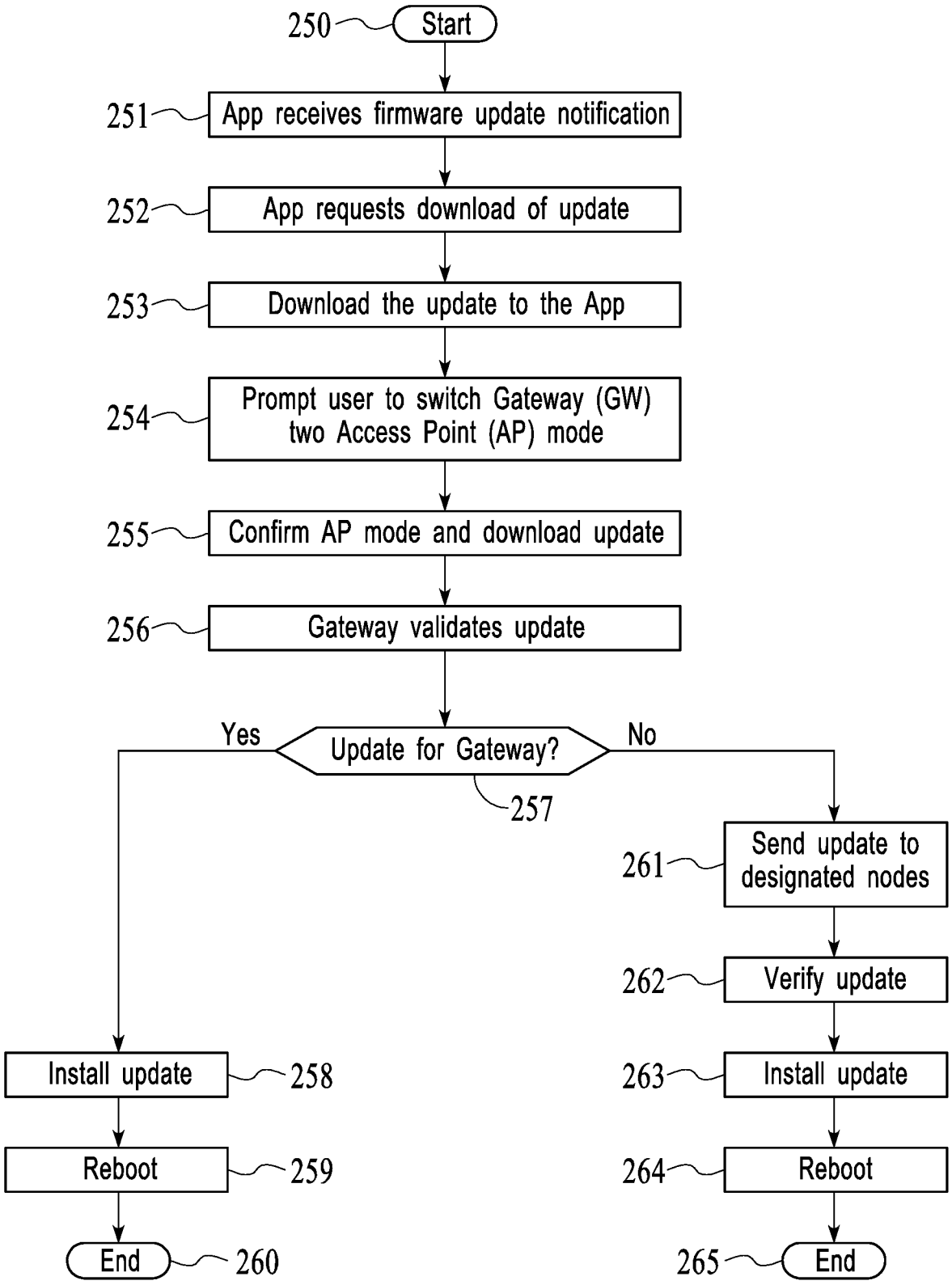
FIG. 15 is a flowchart of an exemplary process for over the air (OTA) firmware updates of gateways and targets/nodes in accordance with exemplary preferred embodiments of the present invention.

In preferred embodiments of the present invention, firmware updates are provided to MTs and STs over the air (OTA). An exemplary sequence is illustrated in FIG. 15. As used herein, it should be understood that the process flow generally applies to an independent gateway, but also to gateways within an MT in accordance with such exemplary preferred embodiments of the present invention.

The process starts at 250. At step 251, the app receives a notification that a firmware update is available on a cloud server. At step 252, the app sends a request for the update to be downloaded from the server via the cloud. At step 253, the app downloads the firmware update from the server via the cloud. At step 254, the app either prompts the user to switch the gateway from station or network mode to AP mode such as by changing the gateway status from online to offline mode (in other embodiments, the app may prompt the gateway to change modes and alert the user to this action). At step 255, the app and gateway exchange messages confirming that the gateway is in AP mode (offline), and the gateway thereafter downloads the firmware update from the app. At step 256, the gateway validates the update (e.g., checking data integrity, checksums, etc.) (not validated transmissions preferably prompt a request for a retry of the transmission). At step 257, the gateway determines whether the firmware update is for the gateway or for targets/nodes. If the update is for the gateway itself, at step 258 the gateway installs the firmware update. After installing the firmware update, the gateway preferably reboots itself at step 259. At step 260, the firmware update of the gateway ends. If at step 257 the gateway determines that the update is for one or more targets/nodes, at step 261 the gateway sends the firmware update to the nodes for which the firmware update is applicable (preferably, the update transmission includes information identifying the applicable nodes or information from which the applicable nodes are identifiable). Step 261 may be by a broadcast transmission of the update to multiple targets/nodes, or alternatively the update may be sent to individual targets/nodes one by one via a plurality of transmissions. At step 262 each target/node that receives the firmware update preferably validates the firmware update (e.g., checking data integrity, checksums, etc.) to ensure correct transmission, and if validated the target/node installs the firmware update at step 263 (not validated transmissions preferably prompt a request for a retry of the transmission). At step 264, after installing the firmware update, the target/node that installed the firmware update preferably reboots itself at step 264. At step 265, the firmware update of the target/node(s) ends.

Preferably at reboot steps 259 and 264, a status message is sent from the gateway to the app (or from the target/node to the gateway to the app) confirming the status of the update. Also preferably, after receipt of a status message confirming successful update of the firmware, the app can determine if further updates are desired or needed, and also prompt the user whether the gateway should continue in offline (AP) mode or not. Refinements of the foregoing firmware update process are contemplated; what is important is that firmware updates for performance improvements, adding game modes and the like, are provided via an easy to use an efficient firmware update mechanism, which preferably is OTA.

As will appreciated from the description herein, in certain preferred embodiments, gateways implement 802.11 and 802.15.4 wireless capabilities, although other wireless capabilities are within the scope of the present invention. In certain preferred embodiments, nodes (targets) and gateways communicate over an 802.15.4 radio link, and the gateway communicates to the app via an 802.11 (WiFi) link, which in turn communicates to the cloud. In other embodiments, communications between the gateway and the app may be via Bluetooth, and communications to the cloud may be via a data connection via the smartphone's cellular modem or the link. What is important is that the nodes have the ability to communicate with each other, and one or more of the nodes have the ability to communicate with the gateway, which in turn can communicate with the app and/or the cloud. Also, in certain embodiments, the gateway may be implemented within a node.

As more fully described elsewhere herein, the present invention includes a UI for an app running on a smartphone in accordance with certain preferred embodiments of the present invention. As described/illustrated, in exemplary embodiments gateways may be registered via entry of identification information (such as a MAC address), or alternatively the app may enter a mode whereby a camera on the smart device may scan a QR code to facilitate configuring/registering the gateway to the network. Depending upon network availability, the gateway may connect to the cloud as described/illustrated. Also as described/illustrated, the app may facilitate registration and configuration of targets for use in embodiments of the present invention. Nodes/targets are registered via connection to particular gateways as illustrated. Firmware updates and target configuration and the like are also described elsewhere herein. What is important is that, in accordance with preferred embodiments, an app is provided to register and configure gateways and nodes and to configure targets for modes of operation (e.g., different gaming modes as described herein), and for firmware updates and the like. Such procedures also may configure gateways and nodes for connection to the cloud, such as for purposes described herein.

Exemplary screen shots of one preferred app using in accordance with preferred embodiments of the present invention will now be described with reference to FIG. 16, FIGS. 16A to 16B, FIGS. 17A to 17E, FIGS. 18A to 18E, and FIGS. 19A to 19D. Such exemplary screen shots are to read and understood, for example, as screen shots that may be usable, directly or with modification, to implement the app functionality as described herein and as illustrated in the flowcharts included herewith. The present invention achieves operational and performance benefits from such exemplary screen shots, but the present invention is not limited to any UI feature or features shown in such exemplary screen shots.

Figure 16:
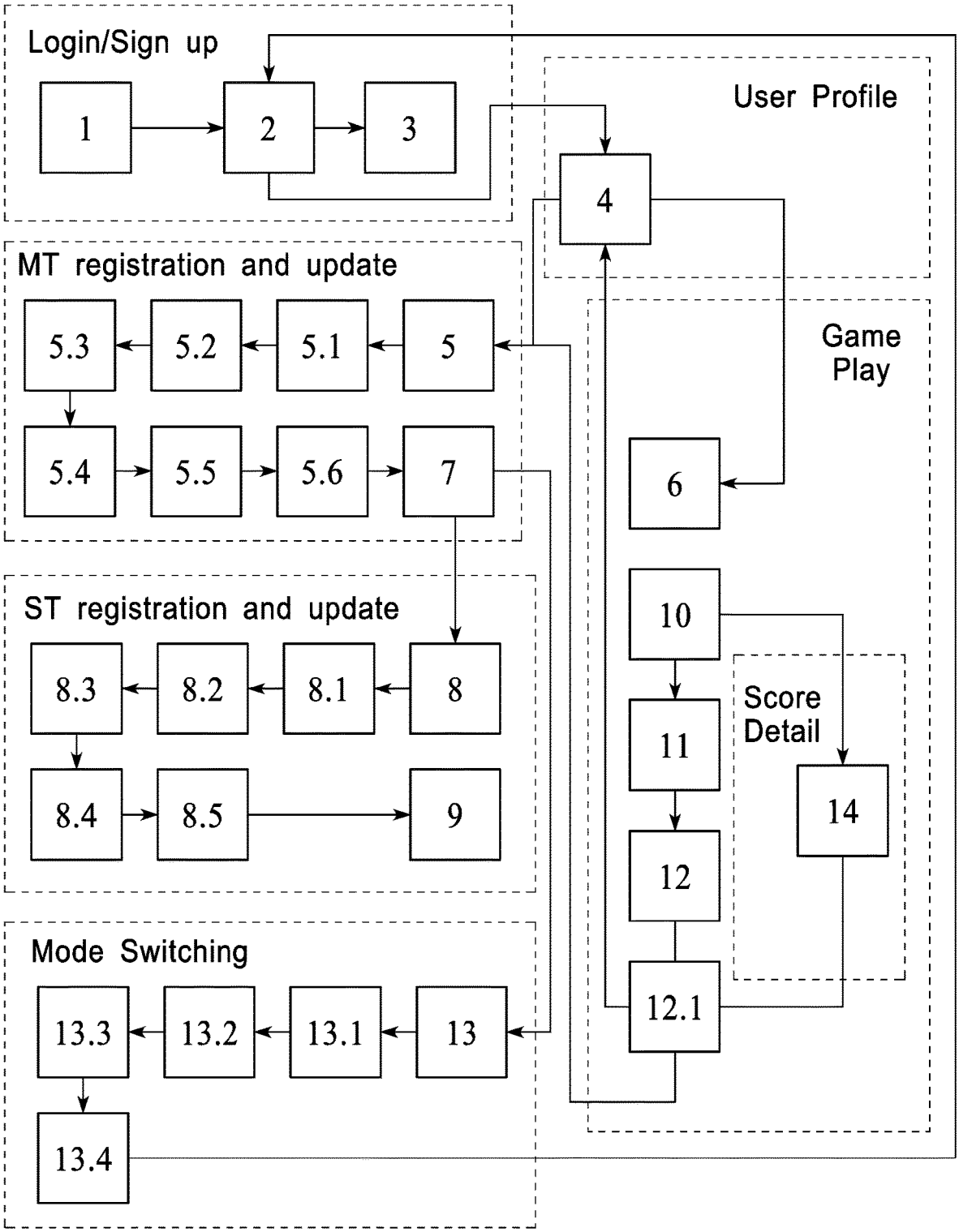
FIG. 16 is a flow diagram providing high level and general guidance through the exemplary screen shots that are in subsequent figures.
Figure 16A:
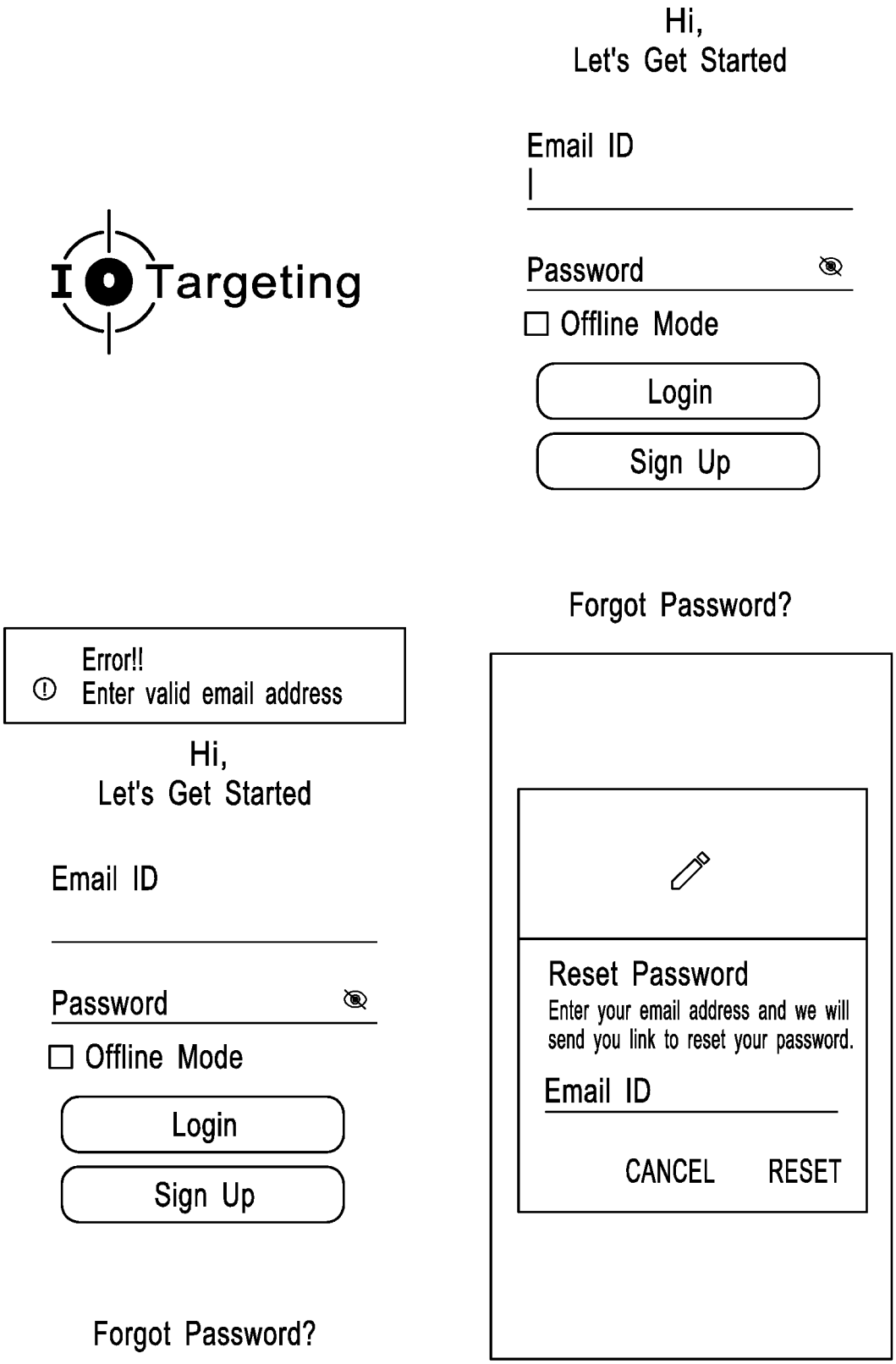
Figure 16B:
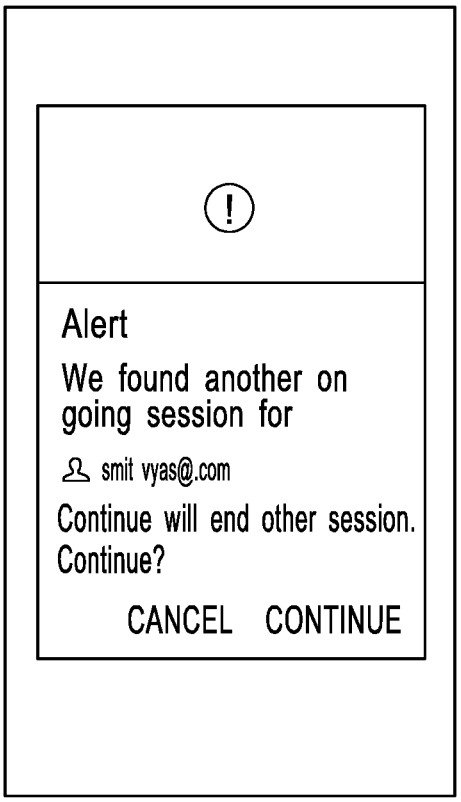
Figure 16B:
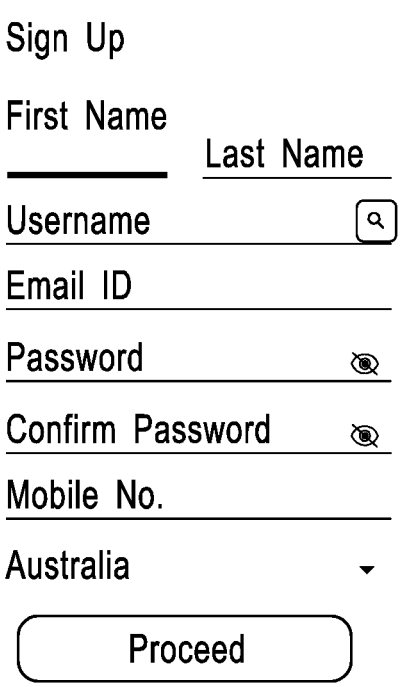
Figure 16B:
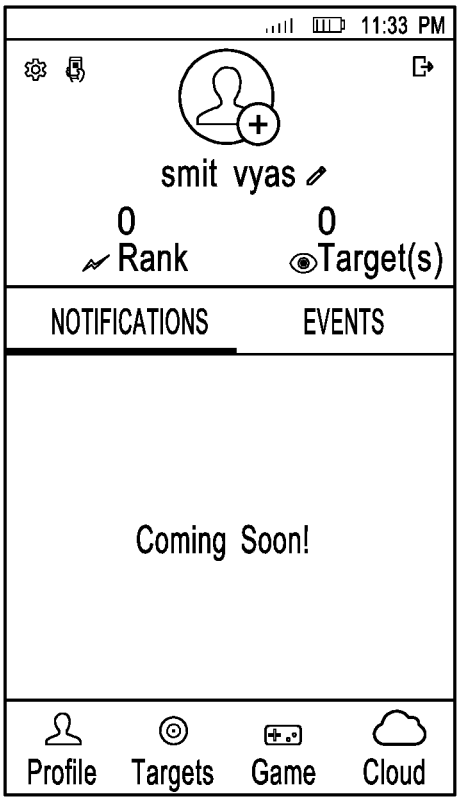
Figure 16B:
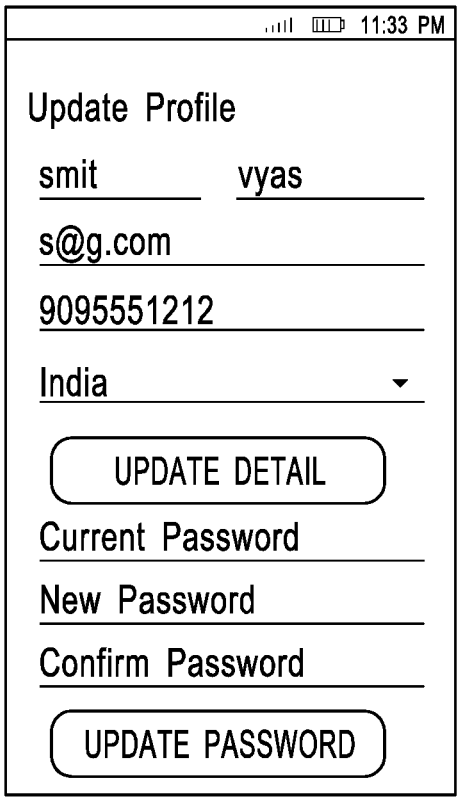
Figure 17A:
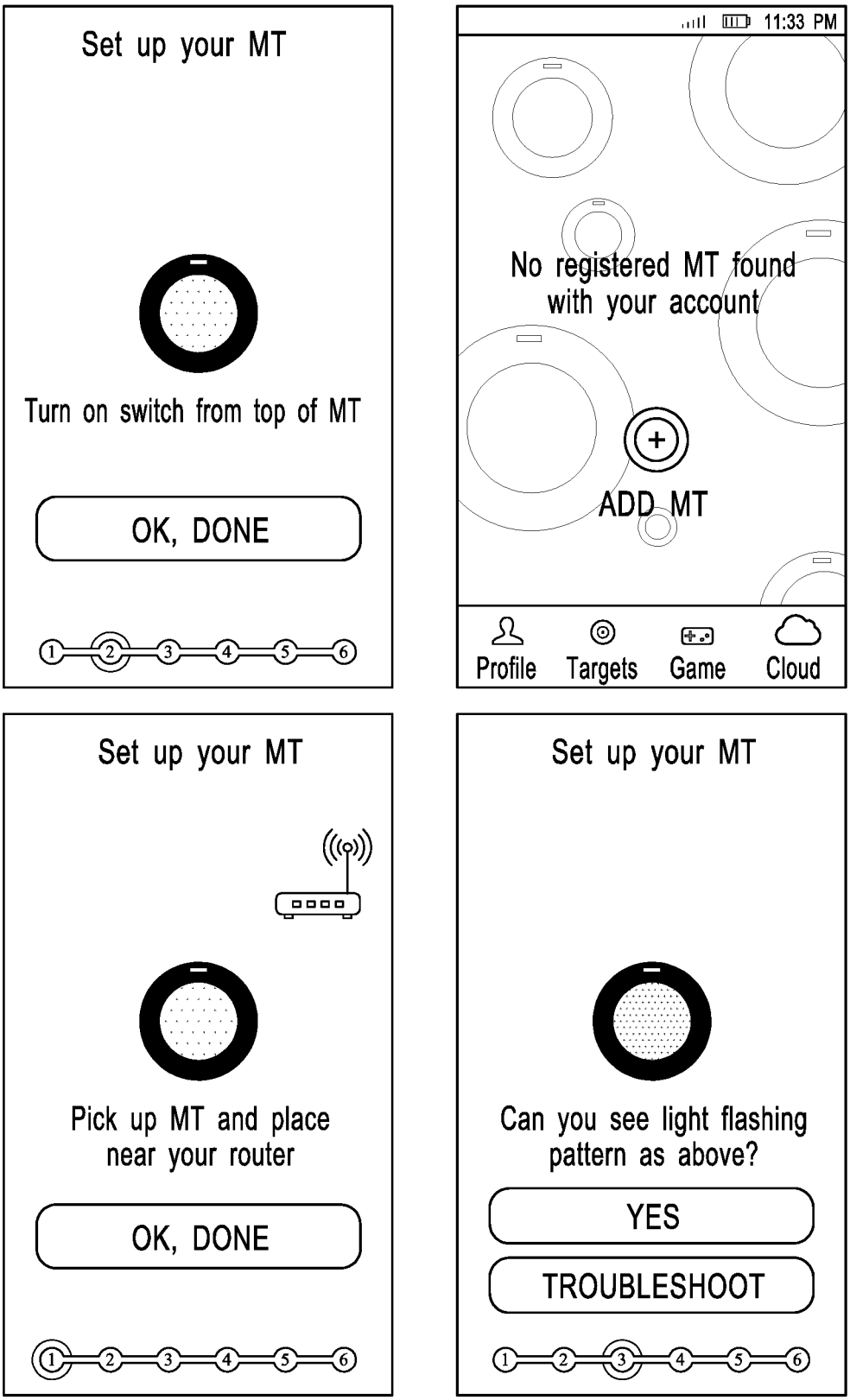
Figure 17C:
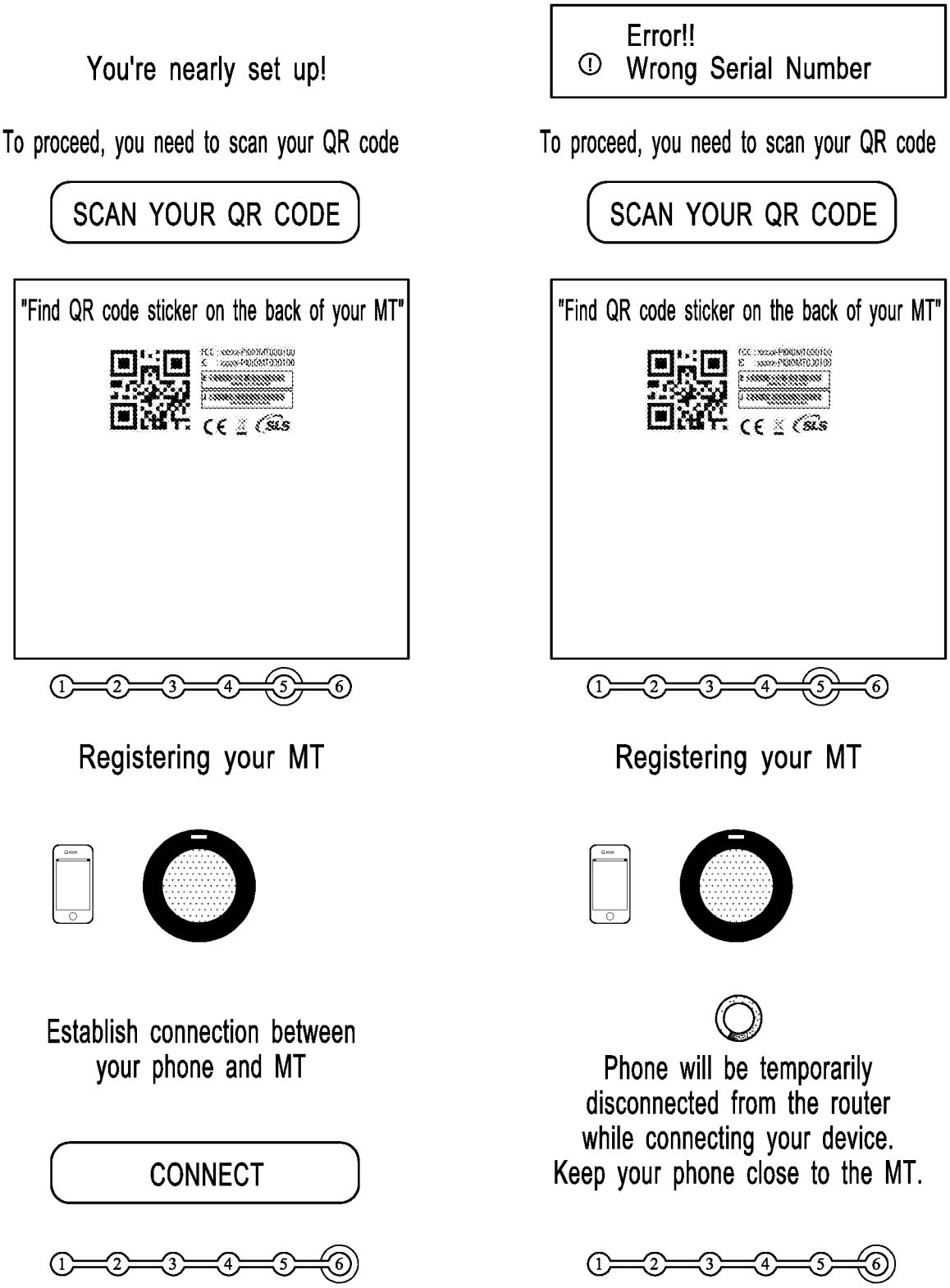
Figure 17D:
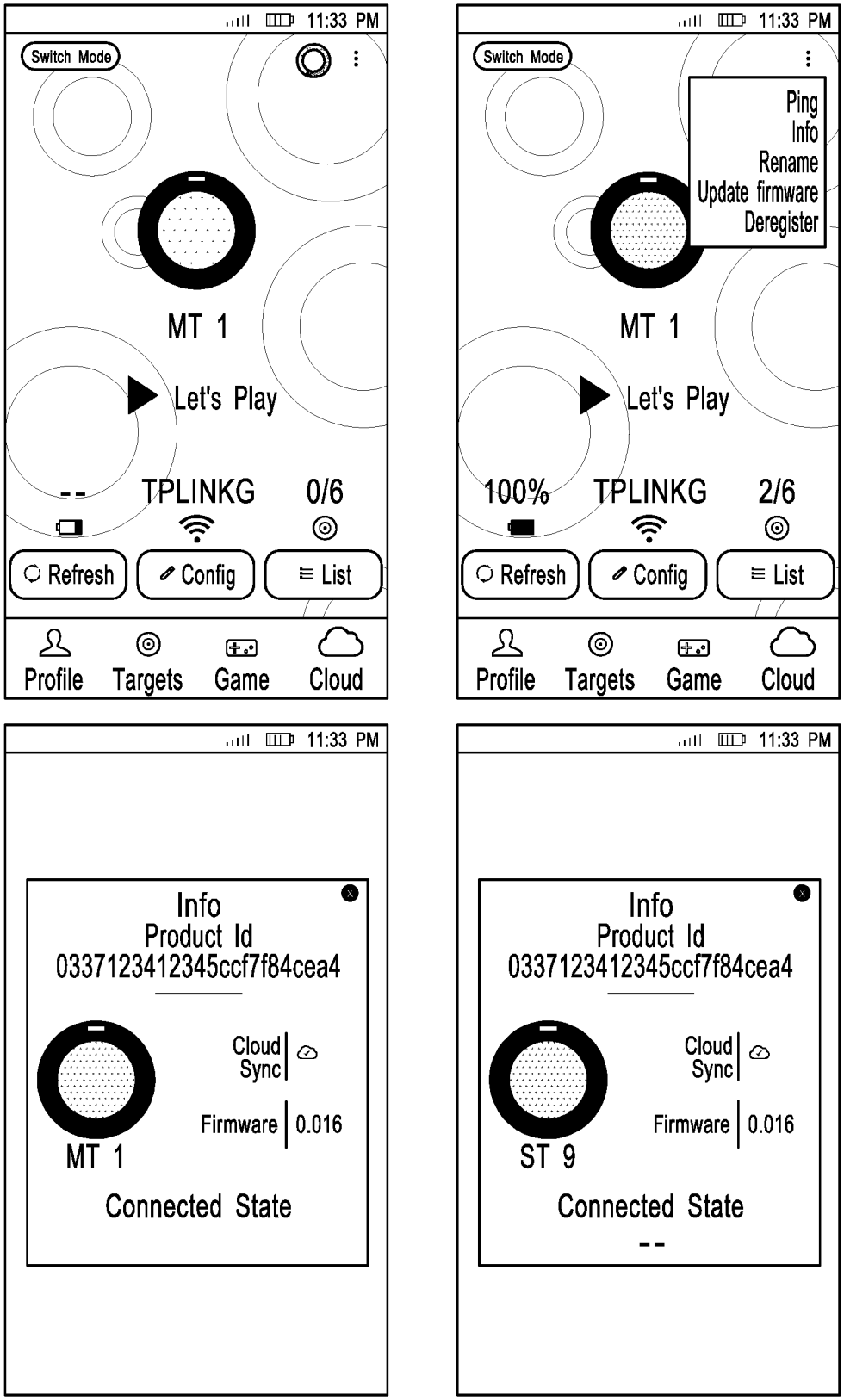
Figure 17E:
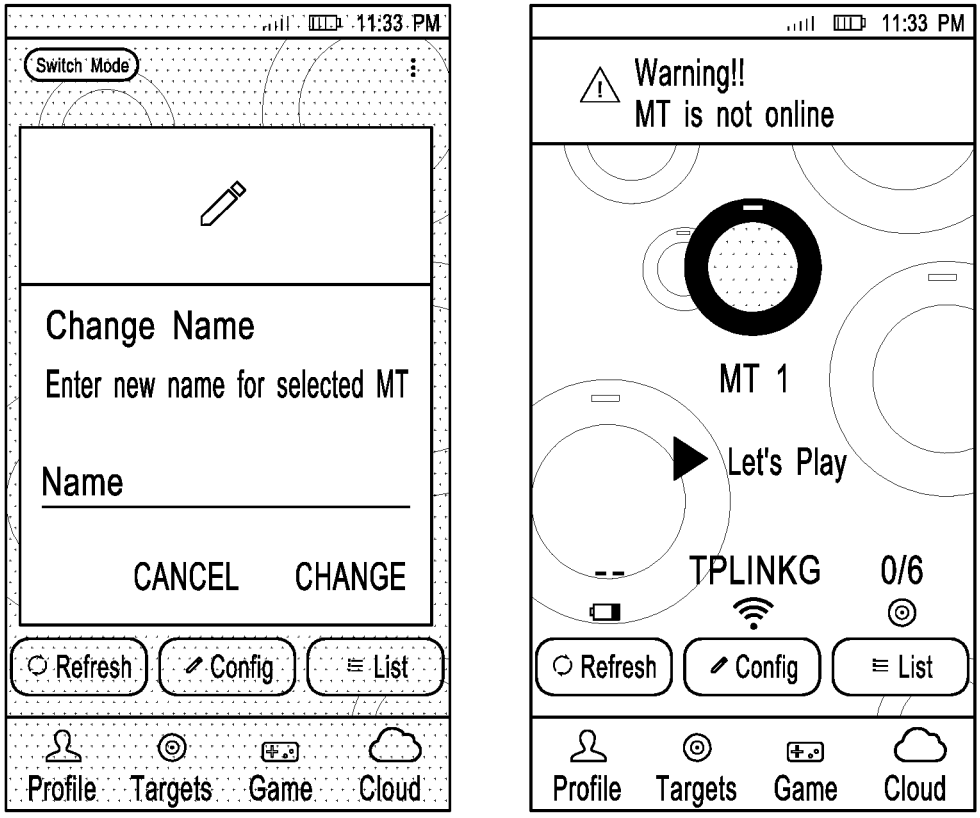
Figure 18A:
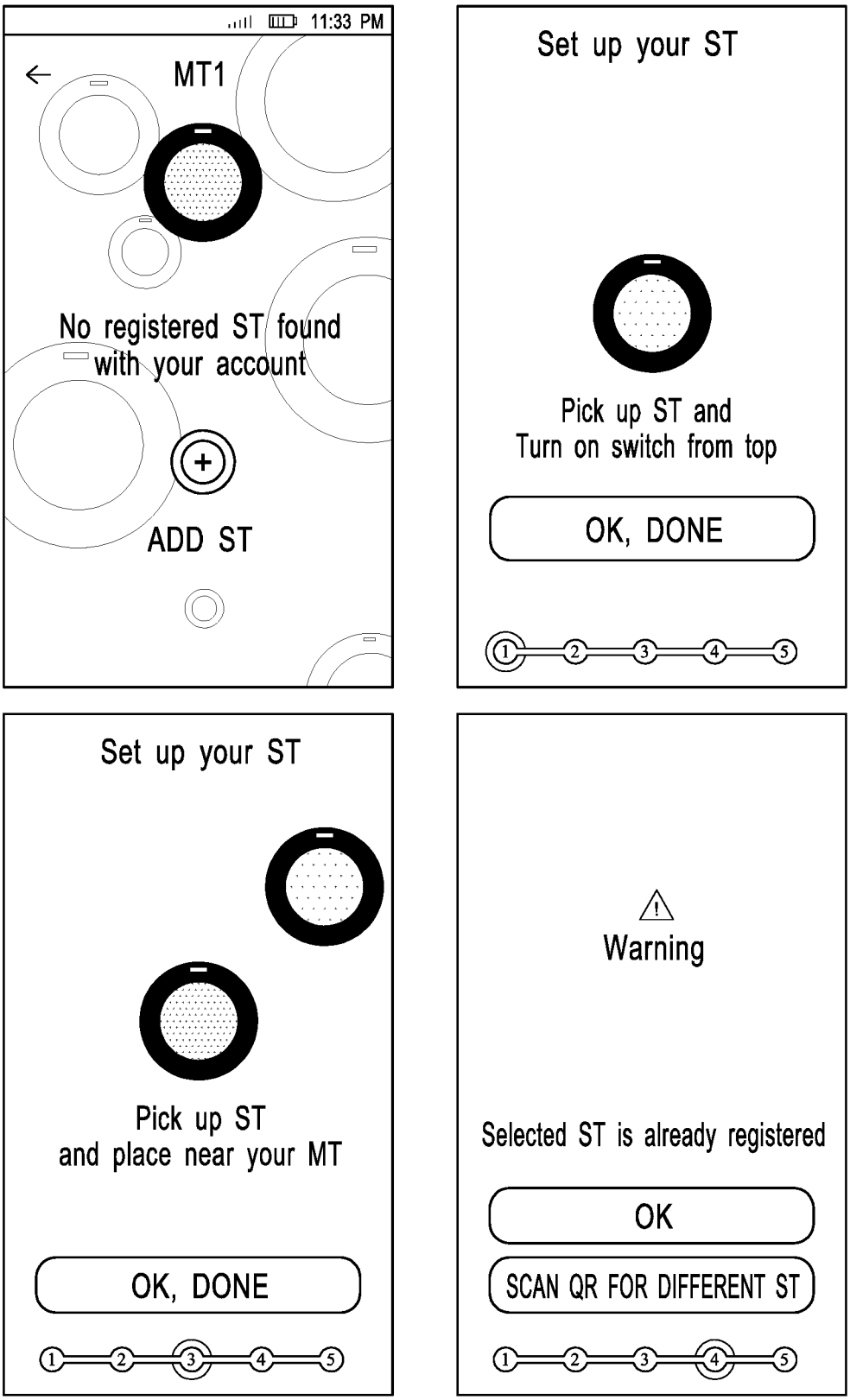
FIGS. 18A to 18E illustrate ST registration and update functions (generally, blocks 8, 8.1 to 8.5, and 9 of FIG. 16).
Figure 18B:
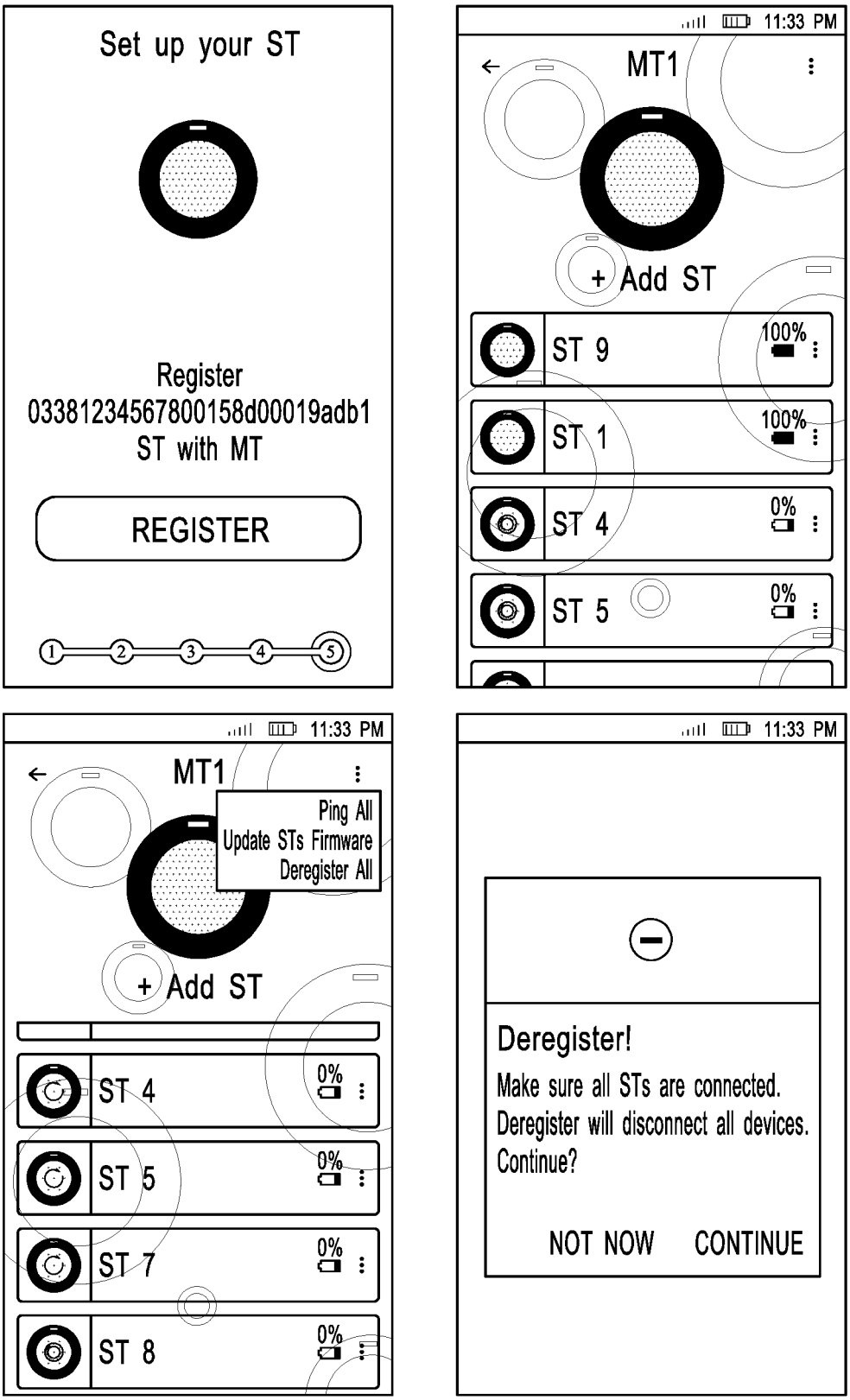
Figure 18C:
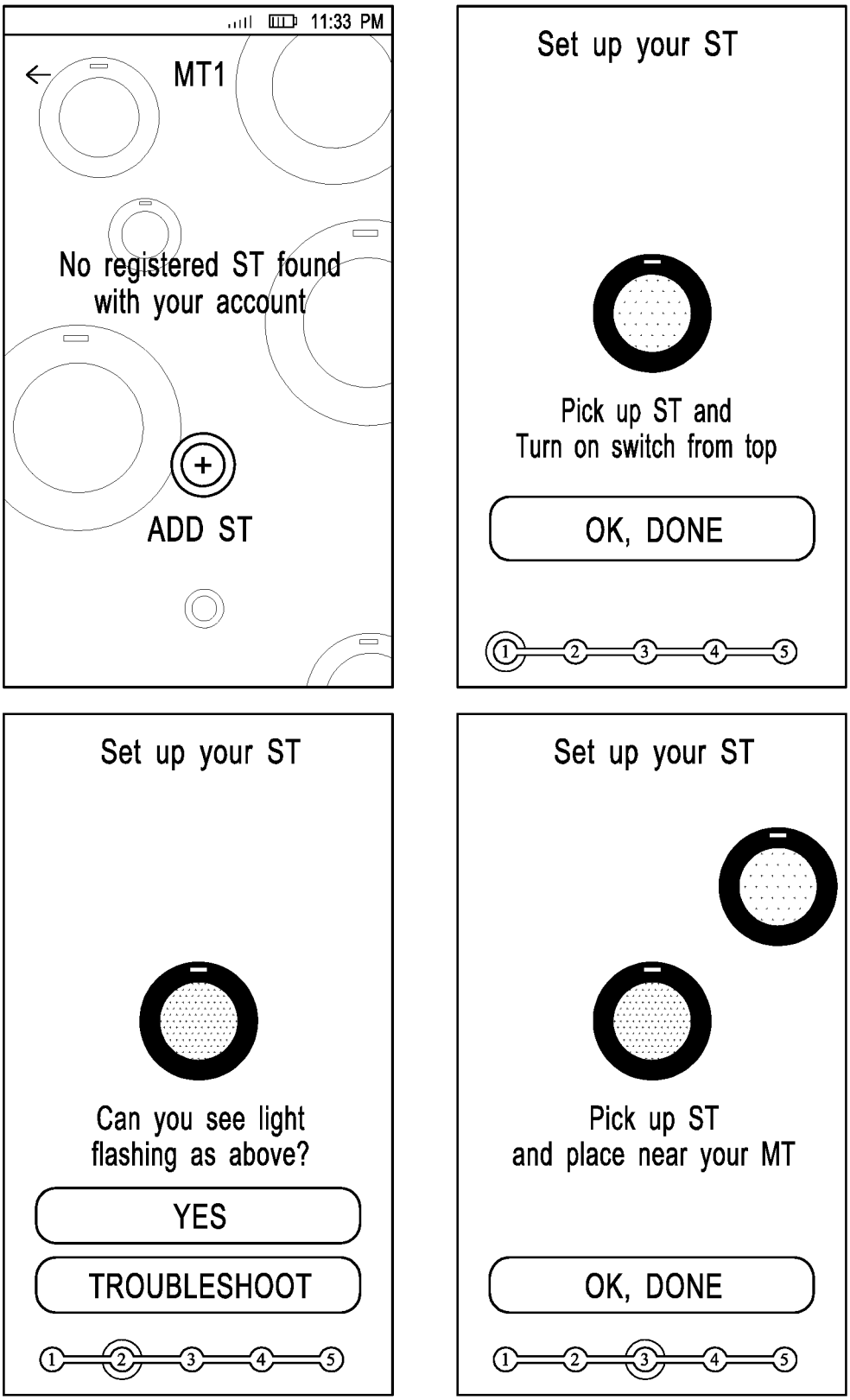
Figure 18D:
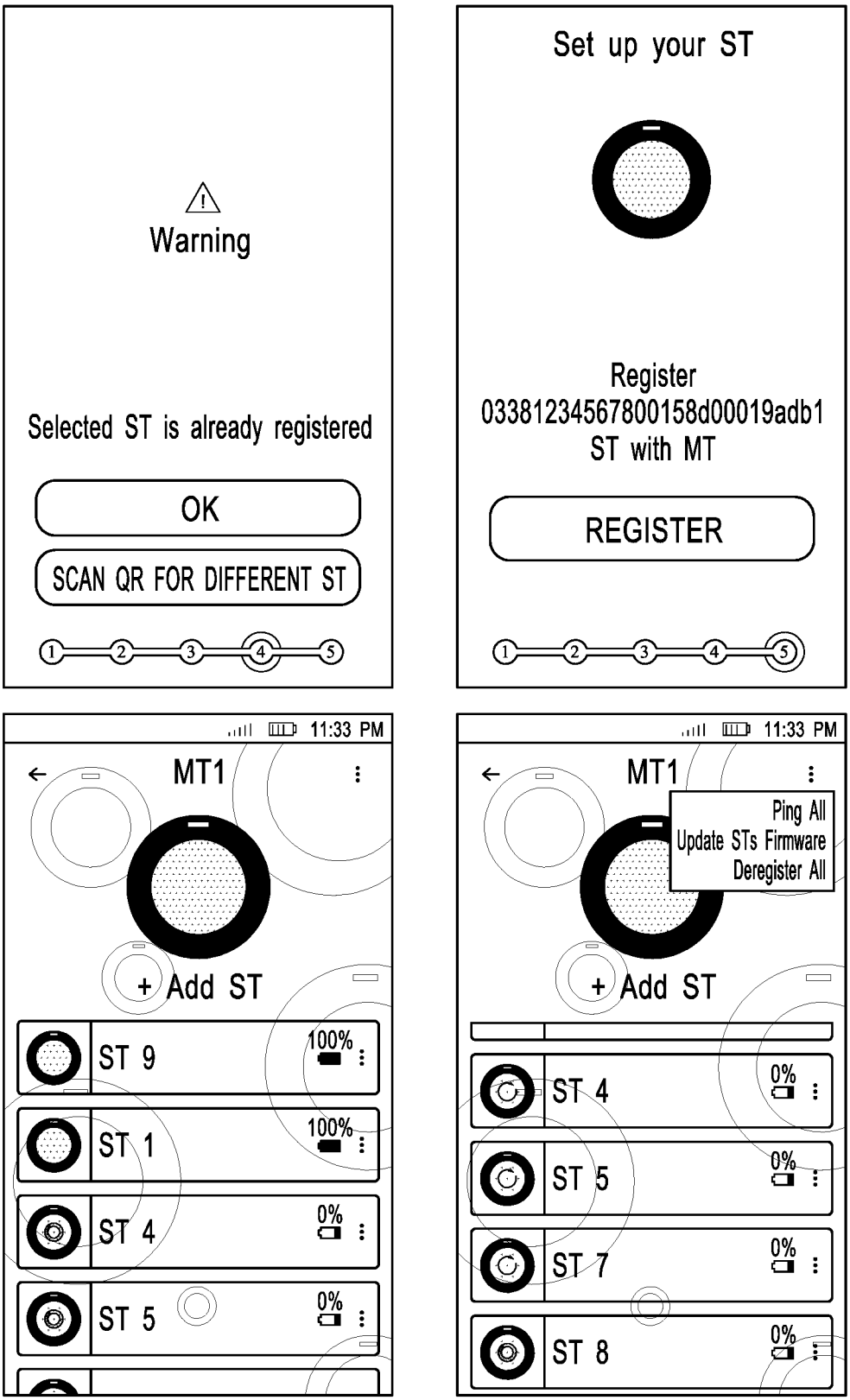
Figure 18E:
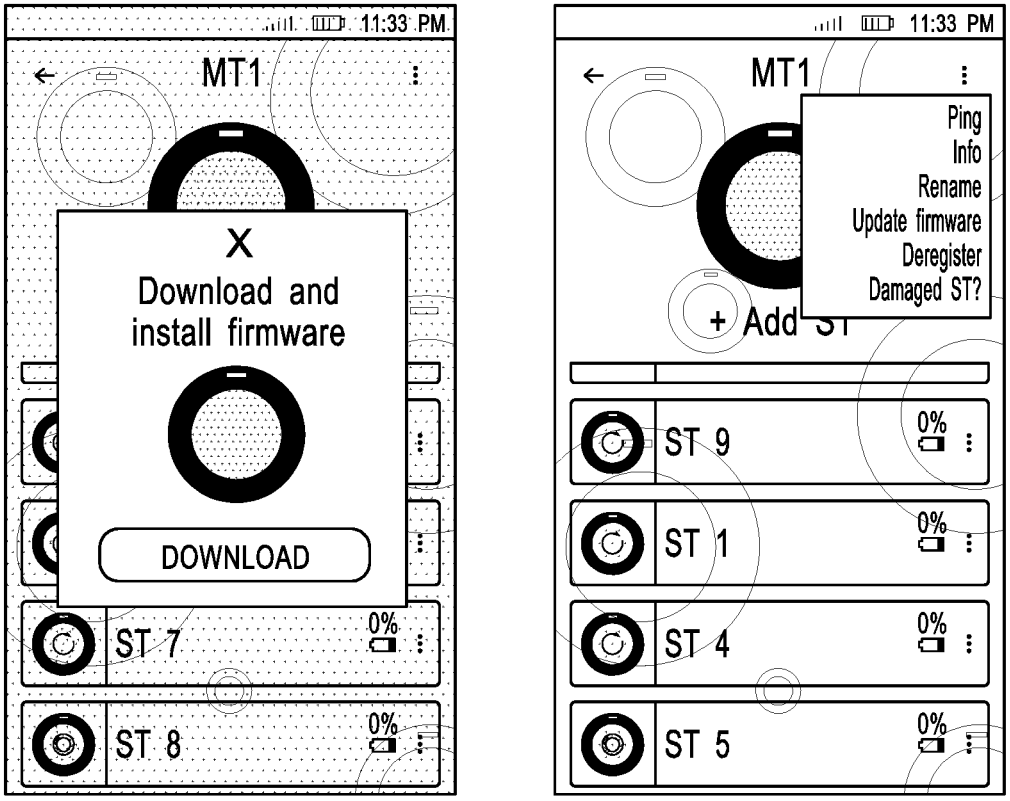
Figure 19A:
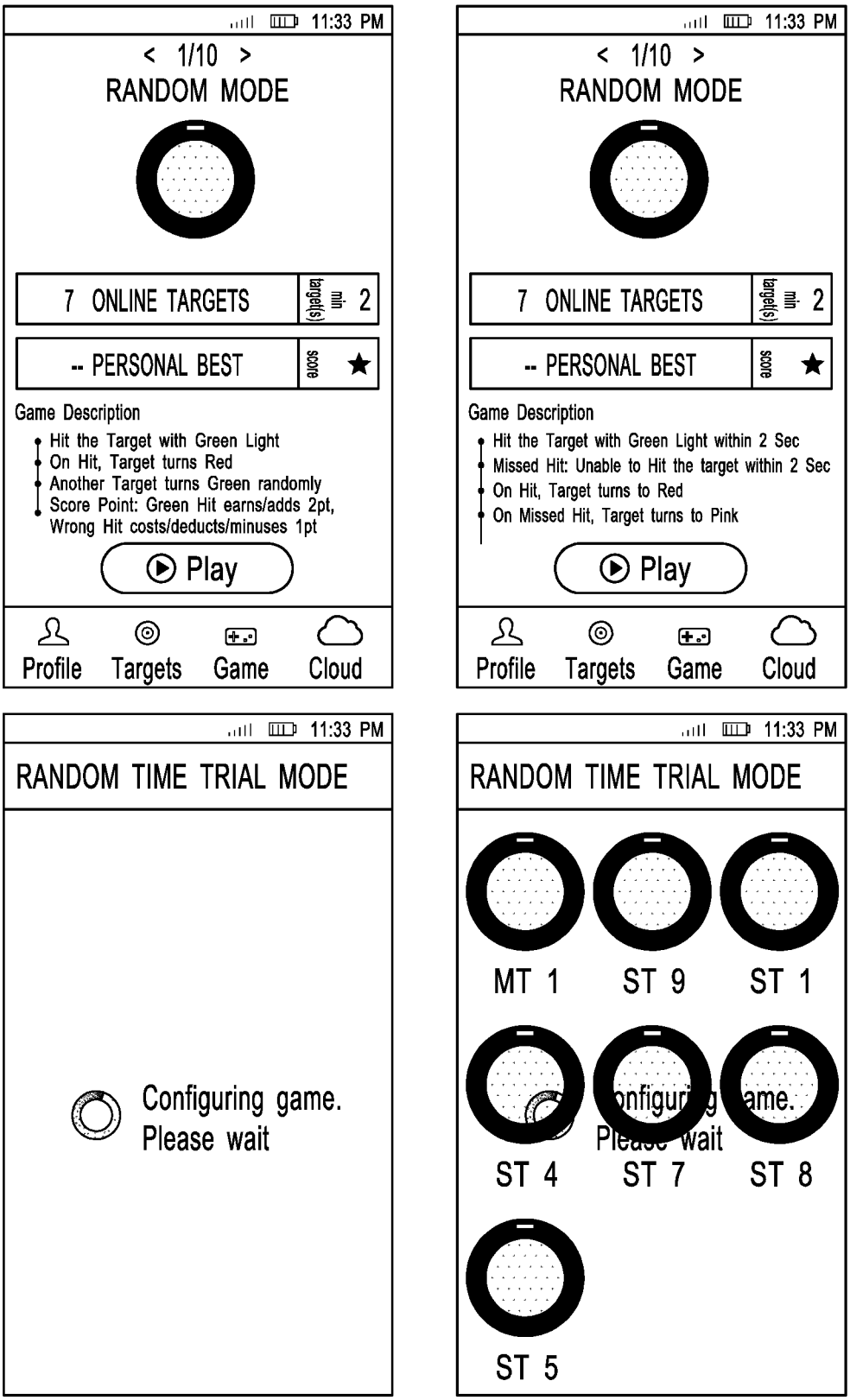
FIGS. 19A to 19D illustrate mode switching, game play and scoring functions (generally, blocks 13, 13.1 to 13.4, 6, 10 to 12, 12.1 and 14 of FIG. 16).
Figure 19B:
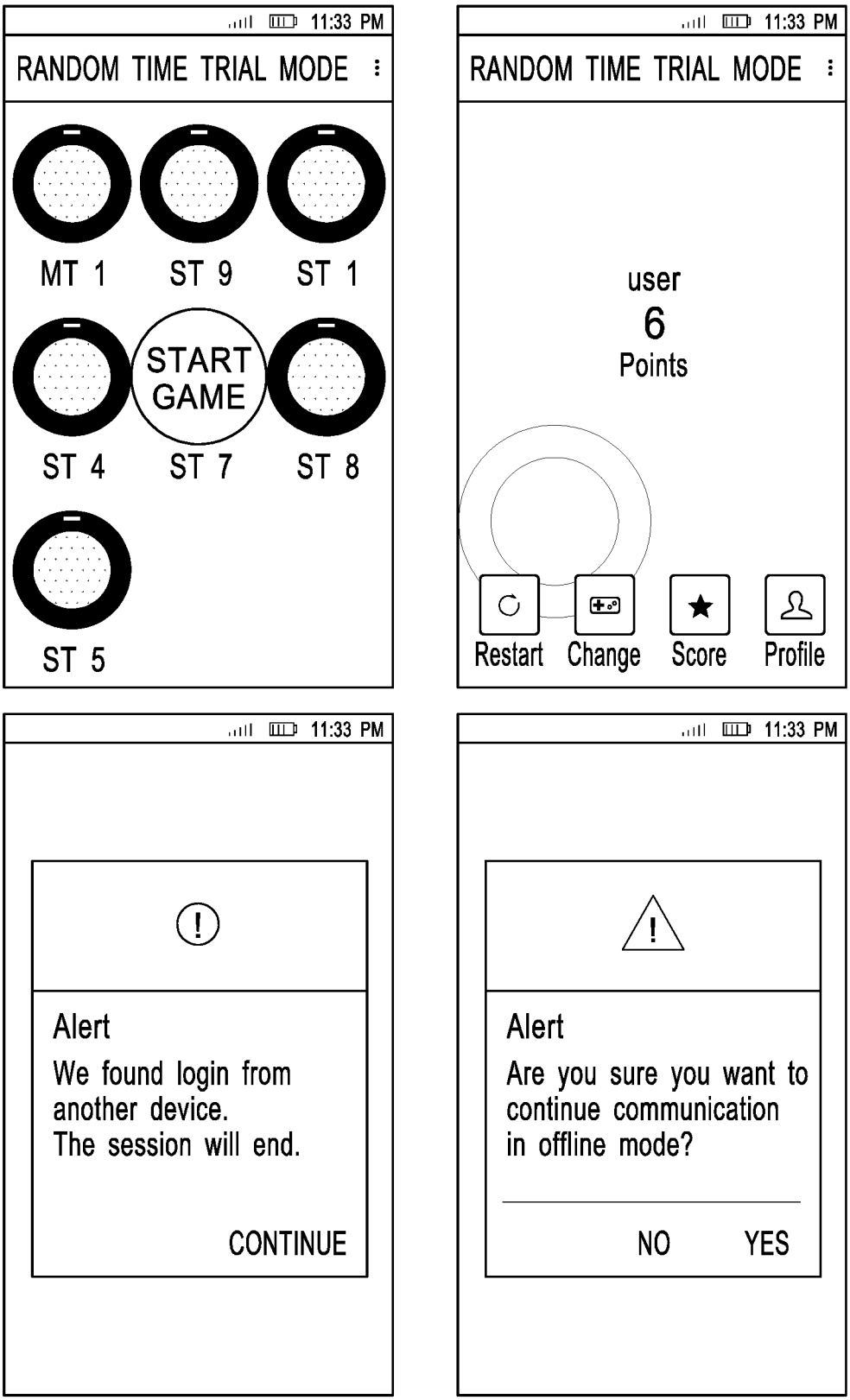
Figure 19C:
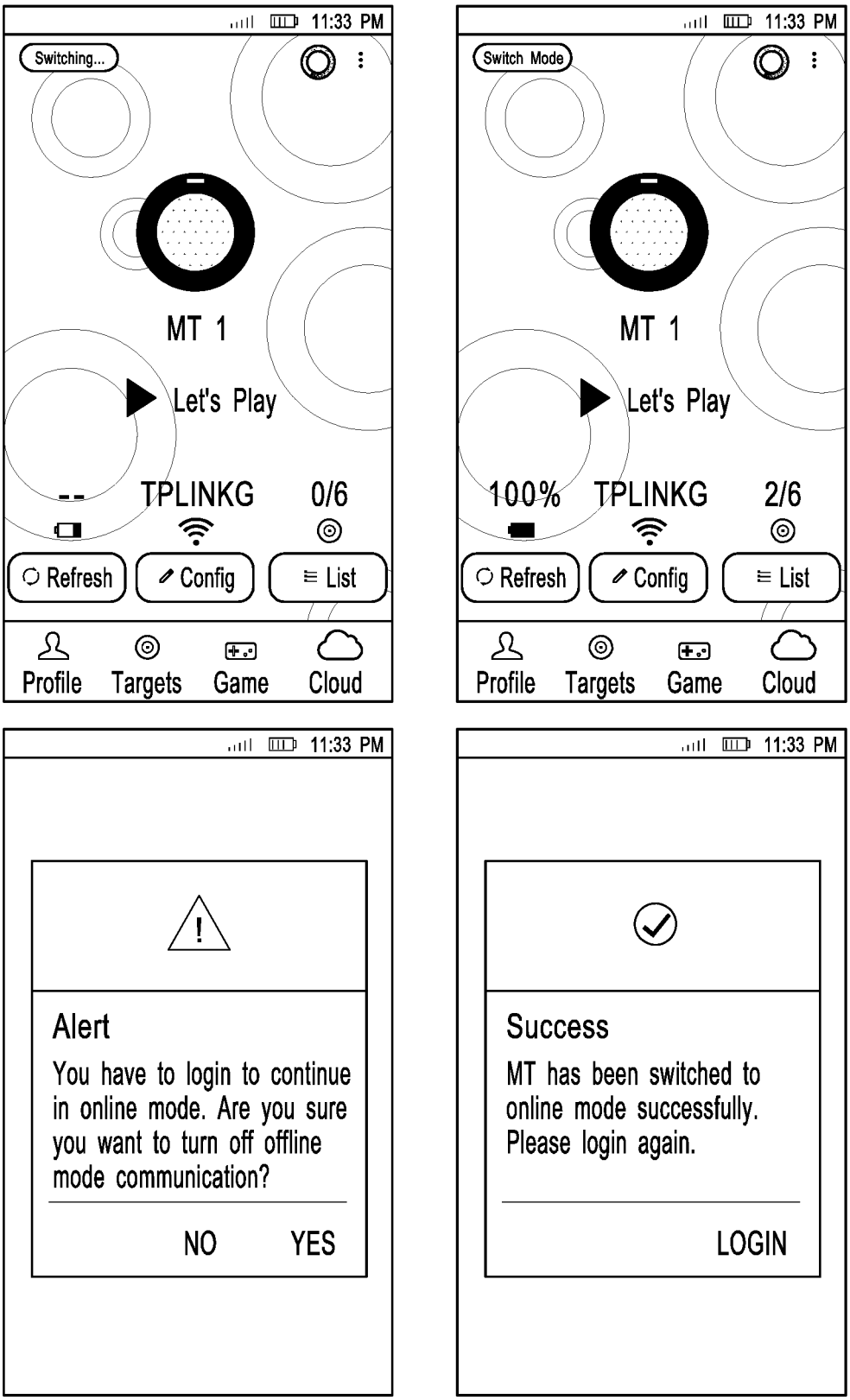
Figure 19D:
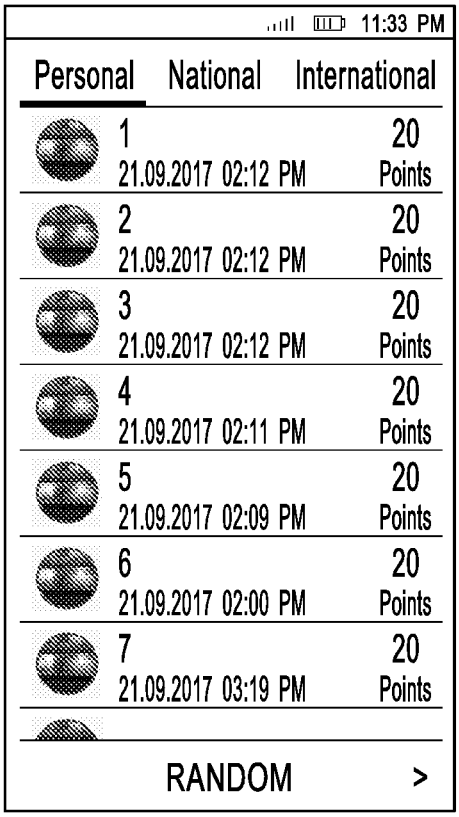

FIG. 16 is a flow diagram providing high level and general guidance through the exemplary screen shots that follow. FIGS. 16A to 16B illustrate login/sign-up and user profile functions (generally, blocks 1-4 of FIG. 16).

FIGS. 17A to 17E illustrate MT registration and update functions (generally, blocks 5, 5.1 to 5.6, and 7 of FIG. 16).

FIGS. 18A to 18E illustrate ST registration and update functions (generally, blocks 8, 8.1 to 8.5, and 9 of FIG. 16).

FIGS. 19A to 19D illustrate mode switching, game play and scoring functions (generally, blocks 13, 13.1 to 13.4, 6, 10 to 12, 12.1 and 14 of FIG. 16).

As will be appreciated by those of skill in the art, such exemplary screens provide an intuitive and flexible interface for users to implement and carryout various operations and functions as described herein.

Figure 20:
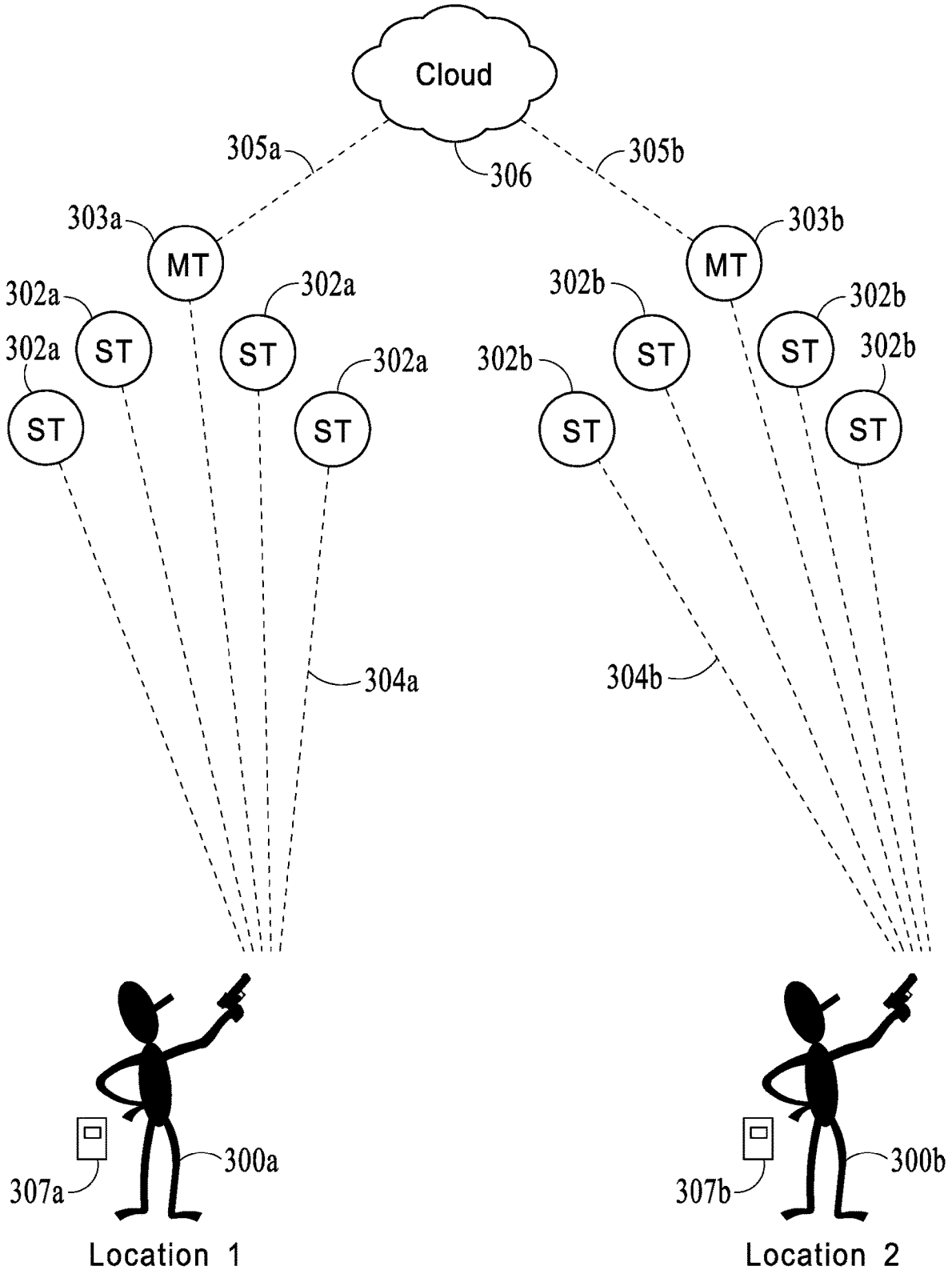
FIG. 20 illustrates an exemplary preferred embodiment having geographically remote users competing in a shooting competition.

Referring now to FIG. 20, an exemplary preferred embodiment of the present is illustrated, by which users in geographically remote locations may compete, for example, in a shooting competition.

As illustrated in FIG. 20, first user 300*a* is at a first location, and second user 300*b* is at a second location. The first location is geographically remote from the second location (e.g., first location is in Canada, and the second location is in India or Texas. User 300*a* has first handheld device 307*a* in proximity at the first location, and user 300*b* has second handheld device 307*b* in proximity at the second location. At the first location, a first plurality of STs 302*a* and a first MT 303*a* are arranged in a pattern (and distance from the first user) (which may be, for example, positions on a wall in shooting range, or at various locations outdoors or indoors but arranged like a shoot course), and at the second location a second plurality of STs 302*b* and a second MT 303*b* are arranged in the same or substantially the same pattern as the pattern at the first location, and the distance from the second user is the same or substantially the same as the distance from the first user at the first location. What is important is that the first and second users have the same number and types in their respective locations, so that each is shooting projectiles 304*a* and 304*b* respectively under similar physical conditions. In addition, at the first location MT 303*a* has radio connectivity to send hit status and related information of the first user to cloud resource 306, and at the second location MT 303*b* has radio connectivity to send hit status and related information of the second user to cloud resource 306. MTs, STs, apps, handheld, etc., all may be implemented in accordance with embodiments described elsewhere herein.

As will be appreciated, with the embodiment of FIG. 20, the first and second user may engage in a shooting or other touch competition, with their respective hit status and related information available via cloud 306 to the other's location (e.g., data transmission to the app on other user's handheld). Thus, they may compete in geographically remote locations, comparing hit status during the competition in substantially real time, and comparing results at the end of the competition, again in substantially real time.

With such an embodiment, the first group of targets is arranged in a first pattern a first distance away from the first user at the first location, and a second group of targets is arranged in the first pattern the first distance away from the second user at the second location. The first user and the second user thus may engage in a competition for hitting the first and second groups of targets, respectively, and target hit status of the first user is transmitted via the cloud from the first location to the second location in substantially real time, and target hit status of the second user is transmitted via the cloud from the second location to the first location also in substantially real time. The first display on the first handheld device at the first location can display hit status information of the second user at the first location, and the second display on the second handheld device at the second location can display hit status information of the first user at the second location.

Figure 21:
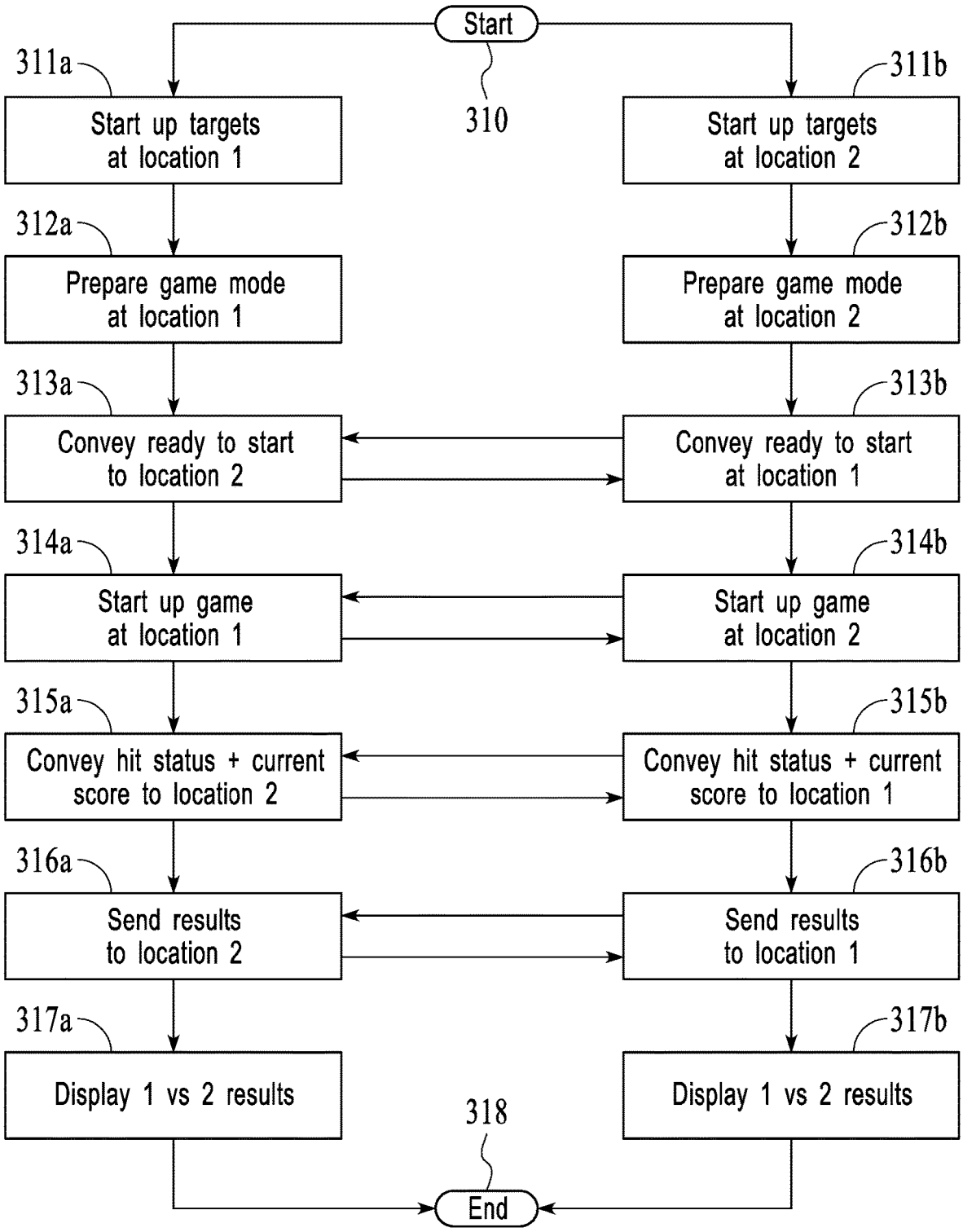
FIG. 21 illustrates an exemplary process flow for a geographically remote competition such as described in connection with FIG. 20.

FIG. 21 illustrates an exemplary process flow for such geographically remote competitions, such as described in connection with FIG. 20.

The competition process flow begins at 310. Generally, the "a" steps are performed at the first location, and the "b" steps are performed at the second location. At step 311*a*/311*b*, at each location the targets are set up in the desired pattern or positional arrangement, ideally with each user at each location being set up to shoot in approximately the same shooting conditions. At step 312*a* and 312*b*, at each location the desired competitive game mode is setup, preferably via the app on a handheld at each location (such as in accordance with the game mode flow described elsewhere herein). At step 313*a*/313*b*, communications occur between the two locations, preferably by way of messages sent to the app at the opposite location. While other communications are possible, what is important at this step is that the users and the controlling app at each location exchange communications so that the game modes are synced and ready for the competition. At step 314*a*/314*b*, the game modes are commenced at each location. Preferably, each location, again preferably via the app at each respective, send and receive messages from the opposite location so that the start of the game mode at each location is synchronized. Thereafter the game mode, and the competition, commences at each location. At step 315*a*/315*b*, communicates occur during the game mode to/from each location. Preferably, this includes hit status, current score, progress indicators, or other information to compare the game progression at each location. Preferably, at each location, a log of hit events and status information is created via the app at each respective location showing the progress of the game/competition. At step 316*a*/316*b*, the game has ended, and again the app on the handheld at each location exchange information via the cloud regarding the results of the game/competition. As will be appreciate, the display on the handheld device at each location may display running results during the competition, as well as displaying results after the competition (step 317*a*/step 317*b*). Preferably the app at each locations stores a log of hit events at both locations, which include time stamps and the like, so that the game progression may be replayed on a timeline or like a movie. In accordance with the flow of FIG. 21, which ends at 318, geographically remote participants may compete in a highly desirous and entertaining manner.

It also will be appreciated that the geographically remote competitions as described herein are not limited to two locations, but can be extended to any desired number. Such more than two user remote competitions are within the scope of the present invention.

As should be appreciated by those of skill in the art based on the descriptions and figures included herewith, industrial applications utilizing one or a plurality of touch-sensitive devices or implements with radio connectivity to other touch-sensitive devices, for connection to the cloud and/or a smart device such as by way of gateway, also are provided by embodiments of the present invention. The present invention is also directed as such applications.

Although the invention has been described in conjunction with specific preferred and other embodiments, it is evident that many substitutions, alternatives and variations will be apparent to those skilled in the art in light of the foregoing description. Accordingly, the invention is intended to embrace all of the alternatives and variations that fall within the spirit and scope of the appended claims. For example, it should be understood that, in accordance with the various alternative embodiments described herein, various systems, and uses and methods based on such systems, may be obtained. The various refinements and alternative and additional features also described may be combined to provide additional advantageous combinations and the like in accordance with the present invention. Also as will be understood by those skilled in the art based on the foregoing description, various aspects of the preferred embodiments may be used in various subcombinations to achieve at least certain of the benefits and attributes described herein, and such subcombinations also are within the scope of the present invention. All such refinements, enhancements and further uses of the present invention are within the scope of the present invention.

What is claimed is:

1. A system for electronic targeting, comprising:

an app running on a handheld device, the app providing a user interface, the handheld device having a first radio capability;

a plurality of targets including at least one master target and at least first and second node targets, each of the targets having electronic hit detection sensors and LED lighting for hit ready and hit status indications, each of the targets having a second radio capability to transmit data/messages indicating hit and status information to the master target;

a gateway integral with the master target, wherein the gateway has the second radio capability to communicate with each of the other targets, wherein the gateway has the first radio capability and communicates via the first radio capability with the app running on the handheld device and transmits data/messages indicating hit and status information to the app running on the handheld device;

wherein data/messages are transmitted directly between the first node target and the master target with no intermediate targets, wherein data/messages are transmitted between the second node target and the master target via the first node target, wherein the first node target is within transmission range of the master target, wherein the second node target is not within transmission range of the master target but the second node target is within transmission range of the first node target.

2. The system of claim 1, wherein the gateway communicates via the first radio capability hit and status information to a cloud server.

3. The system of claim 2, wherein a first group of targets is arranged in a first pattern a first distance away from a first user at a first location, wherein a second group of targets is arranged in the first pattern the first distance away from a second user at a second location, wherein the first user and the second user engage in a competition for hitting the first and second groups of targets, respectively, wherein target hit status of the first user is transmitted via the cloud server from the first location to the second location, wherein target hit status of the second user is transmitted via the cloud server from the second location to the first location, wherein a first display on a first handheld device at the first location displays hit status information of the second user at the first location, wherein a second display on a second handheld device at the second location displays hit status information of the first user at the second location.

4. The system of claim 1, wherein each target includes a rigid target detect board on which three switch/sensors are placed in an approximately 120 degree circumferential pattern around a center point of the rigid target detect board, wherein one or more switch/sensors detect hit of the target by a projectile from a user.

5. The system of claim 4, wherein a richochet-reducing layer is positioned over the rigid target hit detect board at a position more proximate to the user than is the rigid target hit detect board.

6. The system of claim 1, wherein the first radio capability comprises WiFi.

7. The system of claim 1, wherein the first radio capability comprises Bluetooth.

8. The system of claim 1, wherein the second radio capability comprises a Zigbee or 6LoWPAN-based radio capability.

* * * * *